US006446369B2

(12) United States Patent
Cartabbia

(10) Patent No.: US 6,446,369 B2
(45) Date of Patent: Sep. 10, 2002

(54) AUTOMATIC MACHINE FOR IRONING TROUSERS SUCH AS JEANS OR ELASTICIZED OR SPORTS TROUSERS

(76) Inventor: Giavanni Cartabbia, Via Piantada, 9/D, 25036 Palazzolo sull'Oglio (Brescia) (IT)

( * ) Notice: Subject to any disclaimer, the term of this patent is extended or adjusted under 35 U.S.C. 154(b) by 0 days.

(21) Appl. No.: 09/893,921

(22) Filed: Jun. 28, 2001

(51) Int. Cl.[7] ..... D06F 71/28
(52) U.S. Cl. ..... 38/7; 223/73
(58) Field of Search ..... 38/7, 14; 223/57, 223/72, 73, 74

(56) References Cited

U.S. PATENT DOCUMENTS 2,726,021 A * 12/1955 O'Boyle ..... 223/73
3,525,459 A * 8/1970 Buckley et al. ..... 223/73
3,823,854 A * 7/1974 Everett ..... 223/73
4,479,314 A * 10/1984 Frushtick ..... 223/73

* cited by examiner

*Primary Examiner*—Ismael Izaguirre
(74) *Attorney, Agent, or Firm*—Hedman & Costigan, P.C.

(57) ABSTRACT

The present invention relates to an automatic machine which has been specifically designed for ironing trousers free of folds, preferably of a jeans type, or made of elasticized or sports fabrics, which machine comprises a bearing framework rotatably supporting thereon a plurality of operating assemblies for supporting the cloth articles being ironed, each operating assembly being programmable to automatically perform a plurality of different operations, depending on the type of the trouser fabric and their size.

26 Claims, 23 Drawing Sheets

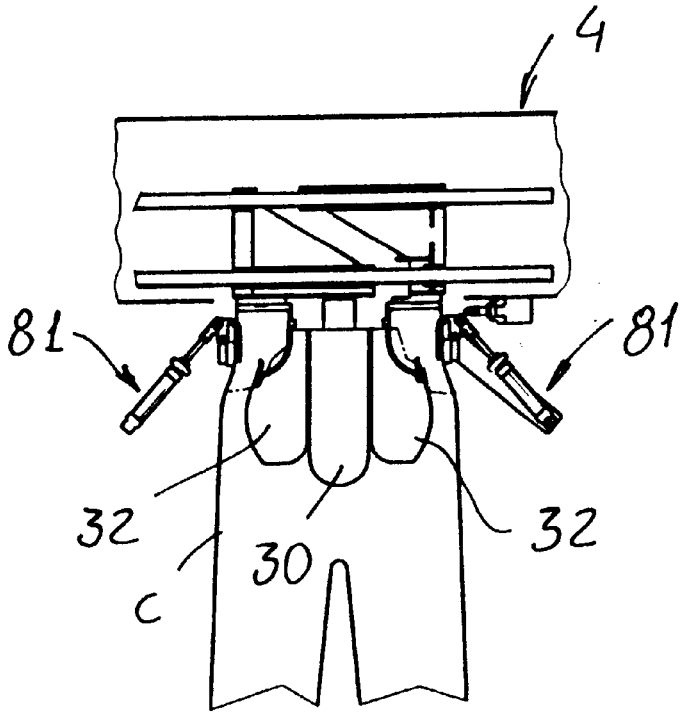
FIG. 23
FIG. 24
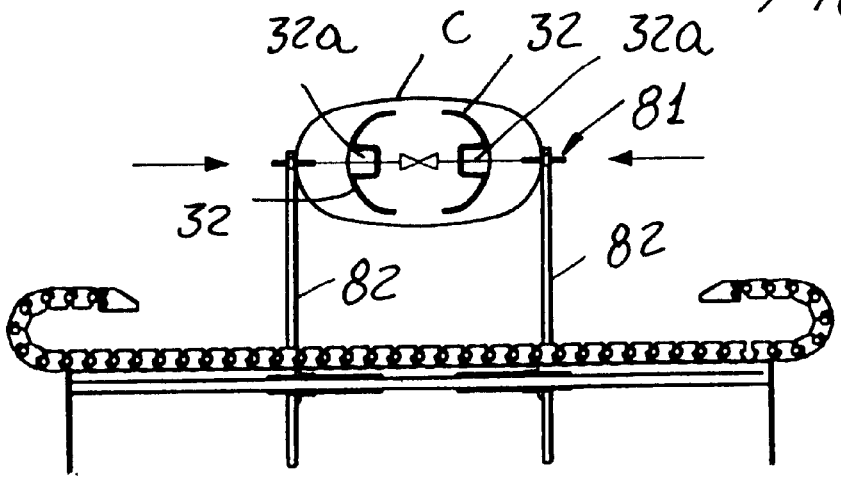

AUTOMATIC MACHINE FOR IRONING TROUSERS SUCH AS JEANS OR ELASTICIZED OR SPORTS TROUSERS

BACKGROUND OF THE INVENTION

The present invention relates to an automatic machine which has been specifically designed for ironing trousers free of folds, preferably of a jeans type, or made of elasticized or sports fabrics.

As is known, in the trouser making field it is necessary to iron and size stabilize the made trousers.

In particular, for making trousers free of folds, or "unfolded" trousers, it is absolutely necessary to perform a plurality of ironing operations, which must be carried out both depending on the trouser fabric type and on the size and size stabilization to be obtained.

At present, the above mentioned operating steps are substantially manually carried out, and the processing operations to be performed must be specifically selected by the operator, to achieve the desired result.

It should be apparent that such a manual processing method, in addition to providing unevenly processed cloth articles, further require a comparatively high labour amount, which seriously adds to the final cost of the made cloth articles.

SUMMARY OF THE INVENTION

Accordingly, the aim of the present invention is to overcome the above mentioned drawbacks, by providing an automatic machine, specifically designed for ironing trousers free of folds, preferably of a jeans type, or made of elasticized or sports fabric, allowing the possibility of controlling, in a fully automatic manner, an automatic sizing of the trousers, both at the pelvic region and leg region of the user, while consequently controlling the size quality of the cloth article during its ironing operation.

Within the scope of the above mentioned aim, a main object of the present invention is to provide such an automatic machine which allows to carry out, in a fully automatized manner, a lot of different trouser processing operations.

Yet another object of the present invention is to provide a trouser ironing machine which, due to its specifically designed construction, is very reliable and safe in operation.

Yet another object of the present invention is to provide such an automatic trouser ironing machine which can be easily made starting from easily available elements and materials and which, furthermore, is very competitive from a mere economic standpoint.

According to one aspect of the present invention, the above mentioned aim and objects, as well as yet other objects, which will become more apparent hereinafter, are achieved by an automatic machine for ironing unfolded trousers, preferably of a jeans type or made of elasticized or sports fabrics, characterized in that said machine comprises a bearing framework rotatably supporting a plurality of operating assemblies for operatively supporting the trousers being processed, and that each said operating assembly can be programmed for automatically carrying out several trouser processing operations depending on the trouser fabric and the inlet of said trouser into said machine, either divided by size or with mixed sizes.

BRIEF DESCRIPTION OF THE DRAWINGS

Further characteristics and advantages of the present invention will become more apparent hereinafter from the following detailed disclosure of a preferred, though not exclusive, embodiment of an automatic ironing machine, specifically designed for ironing unfolded trousers, preferably of a jeans type or made of an elasticized or sports fabric, being shown, by way of an indicative but not limitative example, in the figures of the accompanying drawings, where:

FIG. 23 is a schematic front view showing a removal operation in which the patterns are removed from the ironed cloth article;

FIG. 24 is a schematic top plan view showing a removal operation for removing the patterns from the processed or ironed cloth articles or trousers;

DESCRIPTION OF THE PREFERRED EMBODIMENTS

With reference to the number references of the above mentioned figures, the automatic ironing machine, specifically designed for ironing unfolded trousers, preferably of a jeans type, or made of elasticized or sports fabrics, according to the present invention, which has been generally indicated by the reference number 1, comprises a bearing framework 2, rotatably bearing thereon a carousel element 3 which is provided with four operating assemblies 4 for supporting the cloth articles or trousers being processed or ironed.

Figure 1:
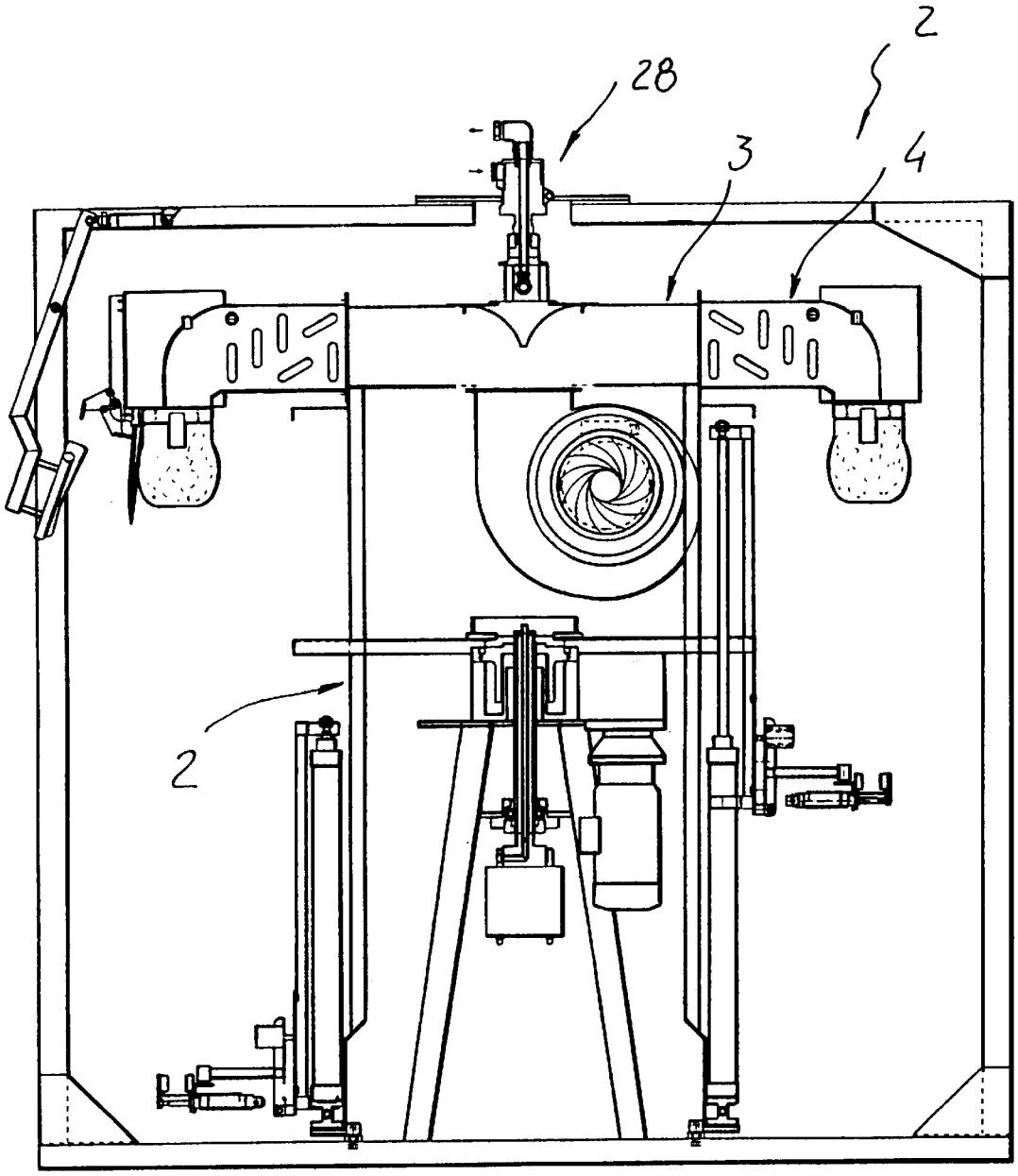
FIG. 1 is a schematic elevation view showing the automatic ironing machine according to the present invention.
Figure 2:
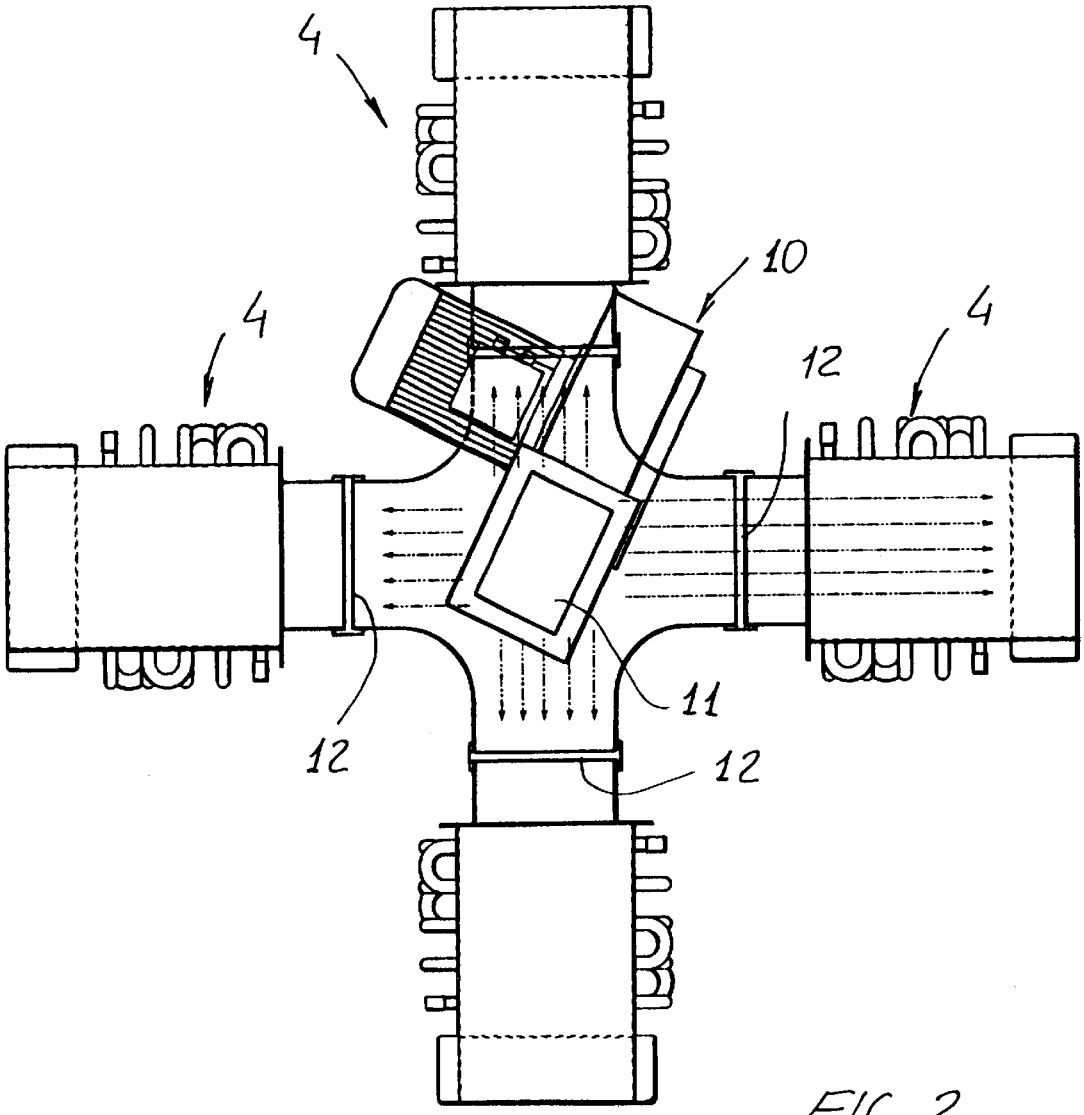
FIG. 2 is a top plan view of the automatic ironing machine according to the invention, clearly showing a blowing pattern thereof.
Figure 3:
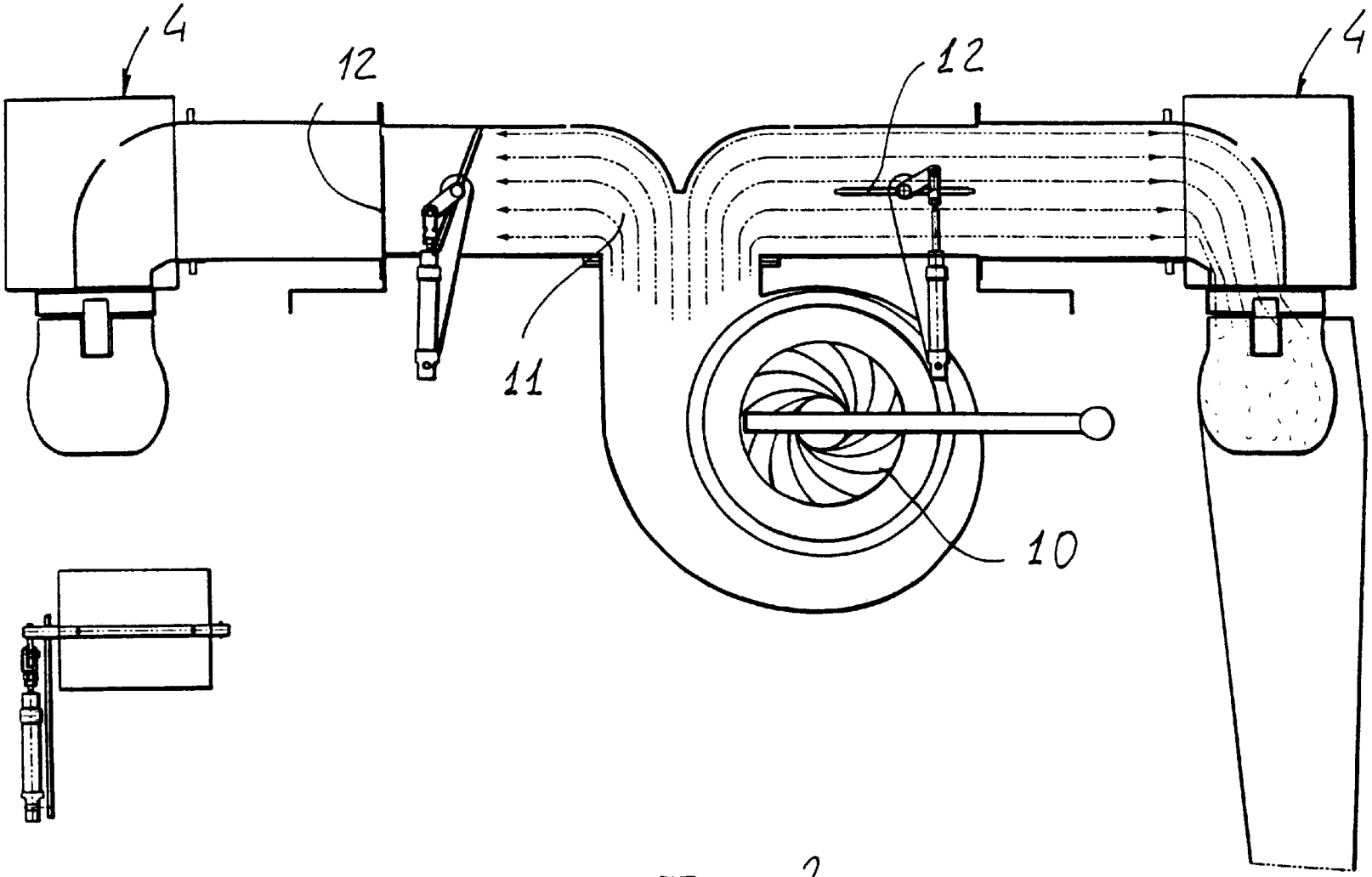
FIG. 3 is a further elevation view illustrating the blowing pattern with which different air blows are distributed to different operating assemblies.

As clearly shown in FIG. 2, inside the mentioned bearing framework, is provided a blower 10 for blowing air inside the several operating assemblies, said blower or blowing unit being coupled to a diffuser 11 which, through adjustment gate 12, communicates with each of said operating assemblies 4, to allow pressurized air to be properly distributed depending on the processing requirements.

The adjustment gate 12, in particular, is electropneumatically driven for a set time, and can be driven to any desired position during the rotary movement of the carousel 3, for one or more gates simultaneously.

Figure 4:
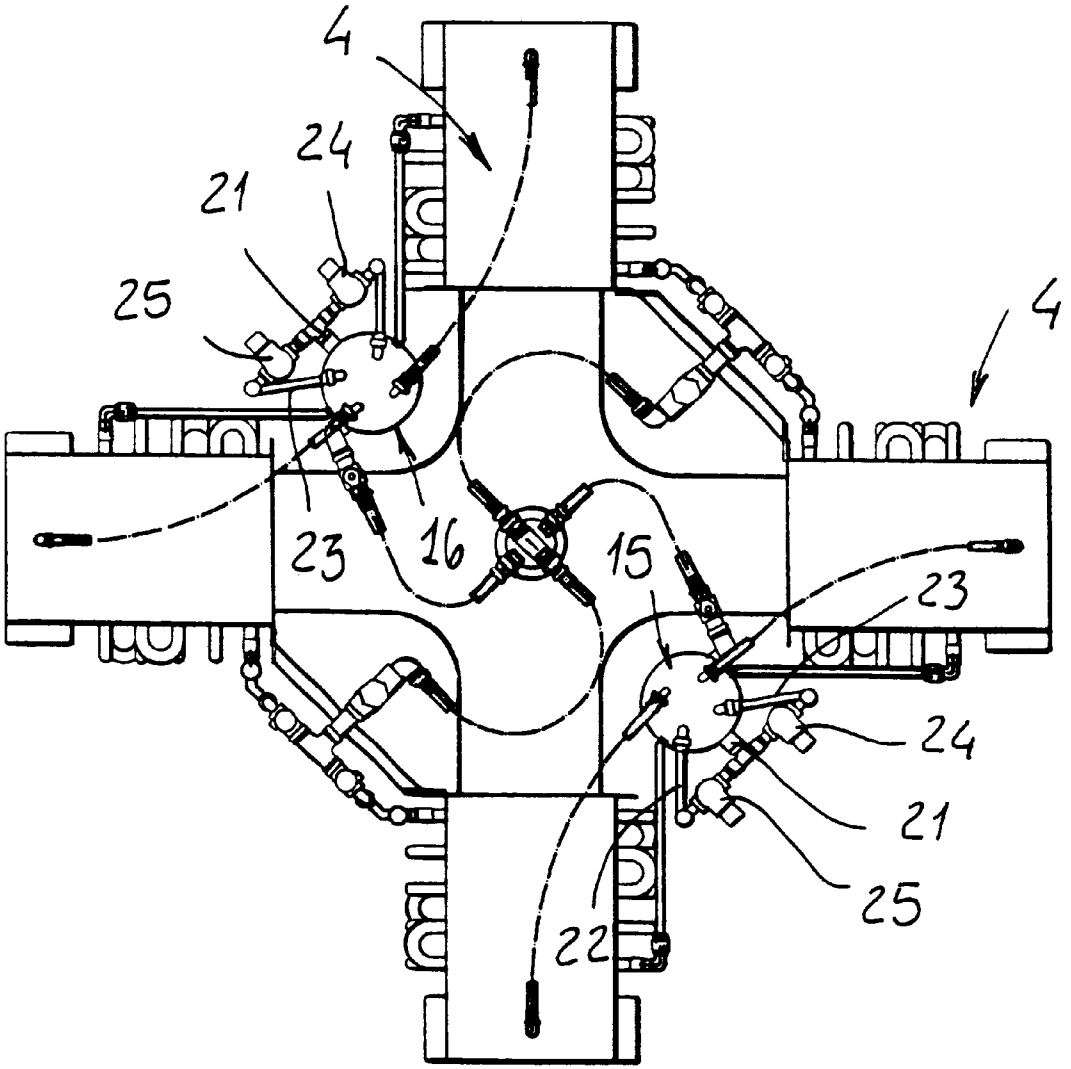
FIG. 4 is a schematic top plan view illustrating the automatic ironing machine according to the invention, and clearly showing the steaming and heating circuits.
Figure 5:
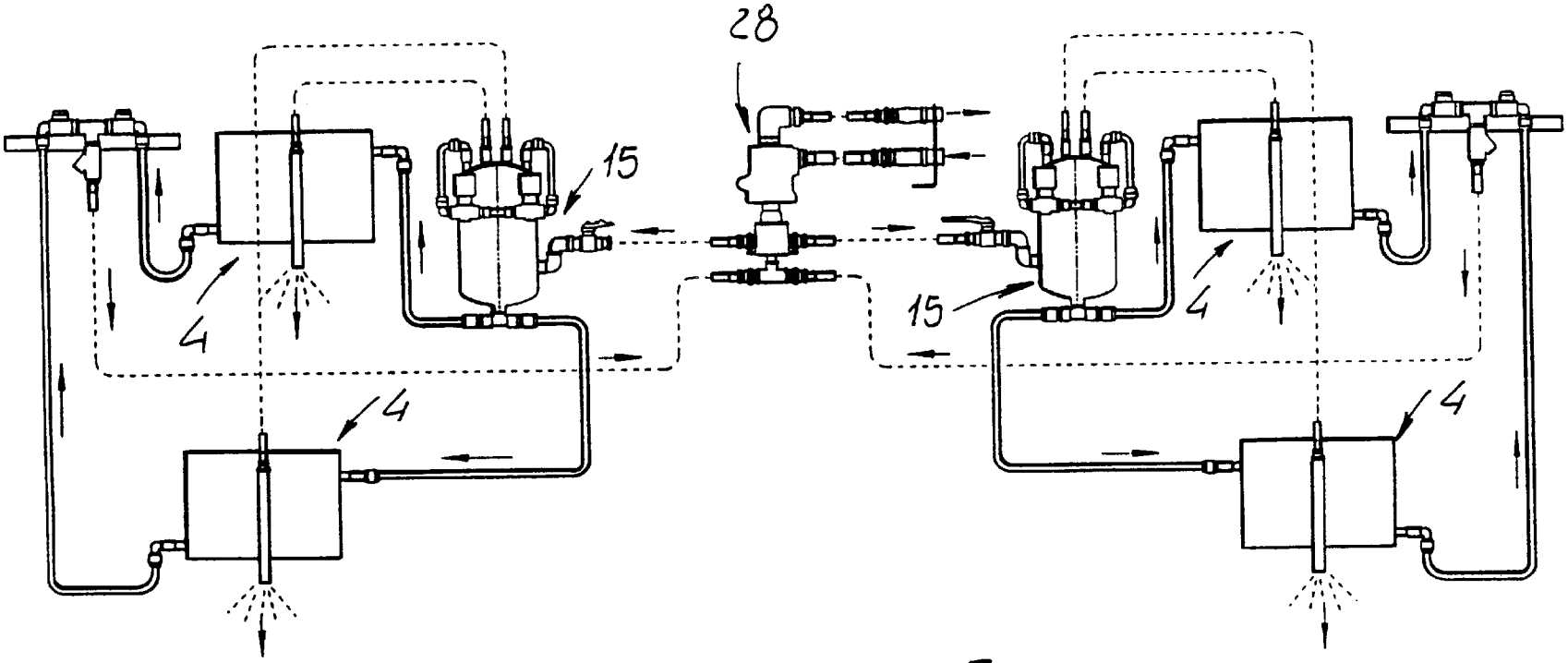
FIG. 5 is a further elevation view illustrating the automatic ironing machine according to the invention, and clearly showing the steaming circuits.
Figure 6:
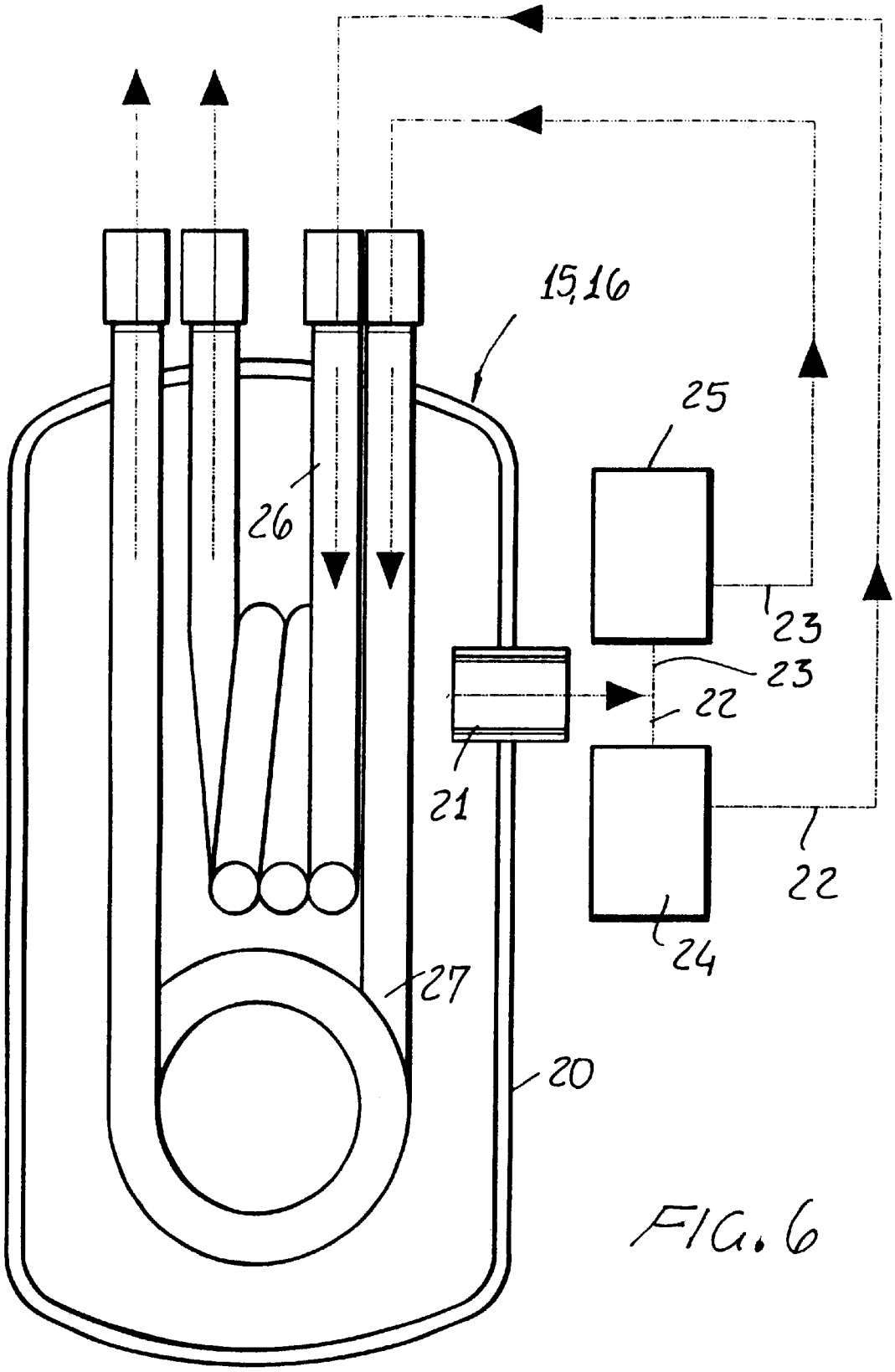
FIG. 6 shows, on an enlarged scale, a detail of the drum assembly for overheating the processing steam.

As clearly shown in FIG. 4, the automatic ironing machine according to the present invention further comprises a plurality of steaming assemblies, which comprise a first and second steaming drums 15 and 16, respectively, which can be coupled to the mentioned operating assemblies.

Each steaming drum 15 and 16 is designed for overheating the steam generated by steam boilers, operating under pressure and at a very high temperature.

The above mentioned device comprises a vessel 20, encompassing each drum, in which a taking or delivery duct 21 is provided, branched into a first branch 22 and a second branch 23, said branches being respectively controlled by a first solenoid valve 24 and a second solenoid valve 25, controlling the communication with a first coil 26 and a second coil 27, arranged inside the envelope 20.

The device allows the steam held in said envelope or vessel 20 to be easily taken, said steam being held at a pressure of about 5 atm and at a temperature of 150° C.

Thus, the steam, by opening one of the mentioned solenoid valves, will be conveyed through the corresponding coil, which is coupled to an atmospheric pressure user source.

Thus, the steam will expand and its temperature will decrease up to 100° C., corresponding to a normal atmospheric pressure.

Then, the steam, after expansion, will be sent into the related coil, arranged inside the mentioned tank where the temperature is of about 150° C.

In this manner, the steam will be overheated to a variable volume, so as to achieve a temperature near to that of the pressurized steam.

By the above mentioned solution, it is possible to generate overheated steam, without using electric overheaters, or gas and oil overheaters, which would involve a very complex construction.

The subject automatic ironing machine comprises moreover a rotary coupling, generally indicated by the reference number 28, providing an inlet for the steam and an outlet for the condensate.

A main feature of the present invention is that each said operating assembly is specifically designed for processing the cloth articles applied thereto by differently programmed modes of operation.

Figure 7:
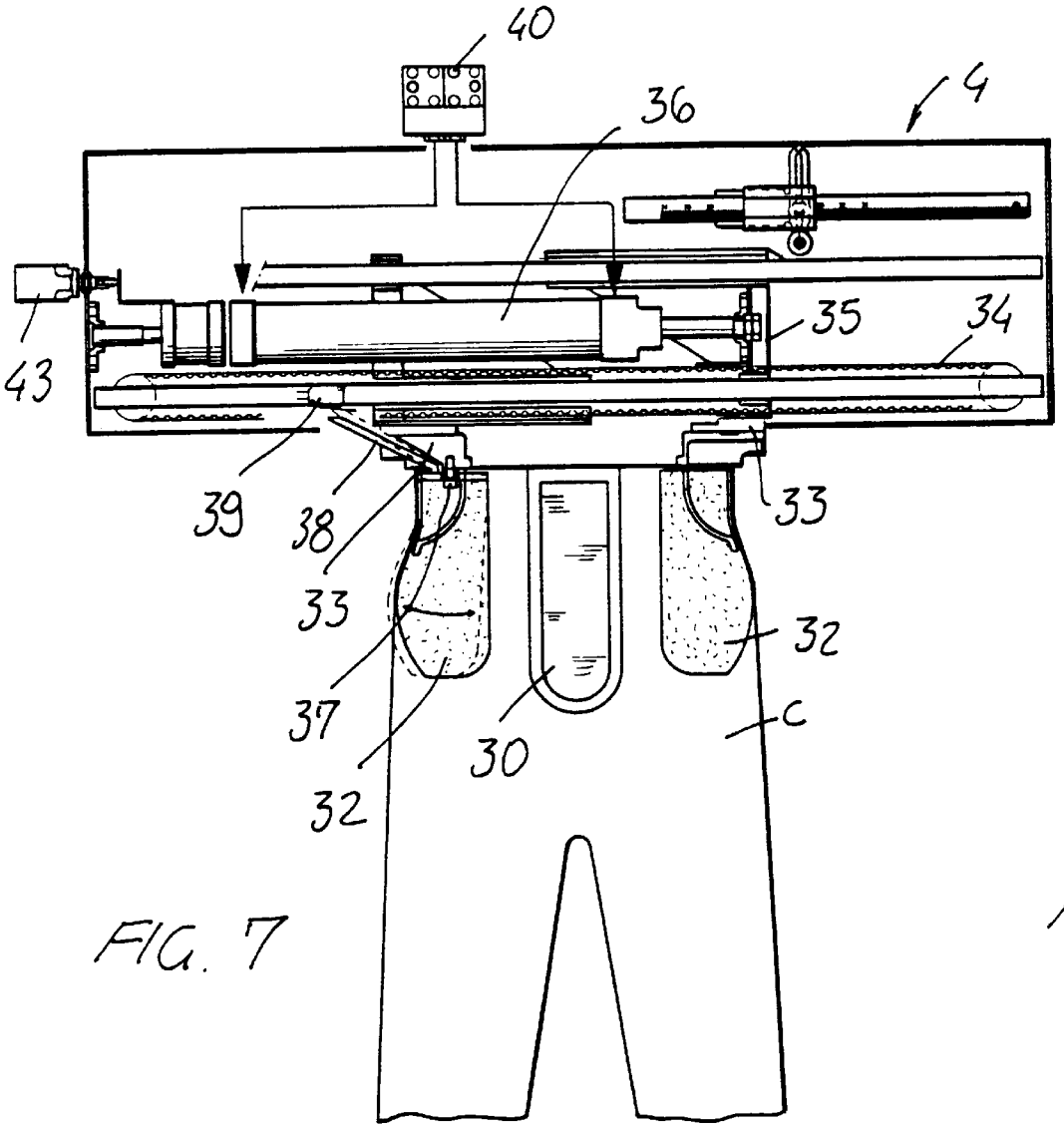
FIG. 7 is a schematic front elevation view showing an operating assembly for processing or ironing trousers or cloth articles made of elasticized fabrics, supplied to the ironing machine with mixed sizes.

As is shown in FIG. 7, each operating assembly 4 generally comprises a fixed frontal plate 30, usually made of a net material, to be arranged inside the flap of the cloth article being processed, and being indicated by the reference letter C.

At the front portion 30, is provided an outside pressing element 31, driven by a cylinder 31*a* provided for firmly holding the cloth article being processed, by bearing thereon.

On a side of the front plate 30 are provided a pair of pelvis templates or shaped elements, generally indicated by the reference number 32, which are swingably mounted about sliders 33 adapted to be horizontally driven.

The sliding movement of said sliders is performed by a collecting cogged belt 34, coupling said sliders so as to cause them to be oppositely slidably driven, said belt being coupled, by a fitting element 35, to a pelvis portion spreading cylinder 36.

Each of said operating assemblies further comprises specifically designed means which are driven depending on the processes to be carried out.

Figure 8:
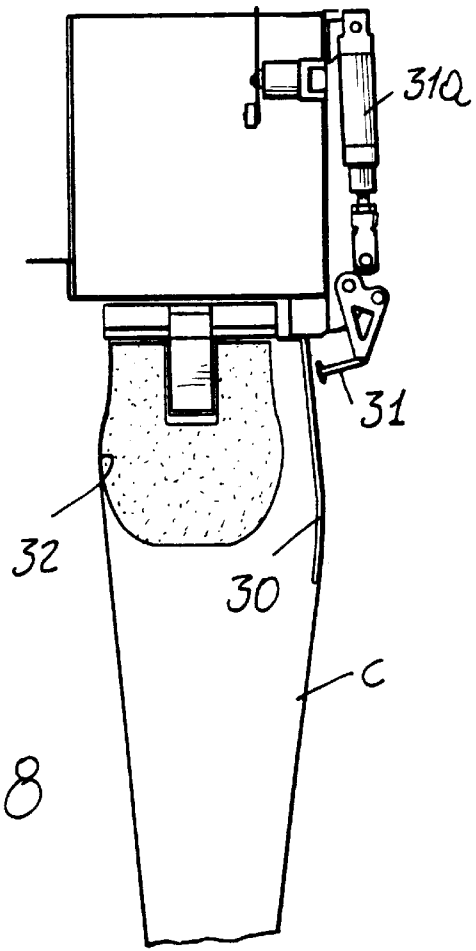
FIG. 8 schematically shows the assembly illustrated in FIG. 7, by a further side elevation view.

With reference, for example, to FIGS. 7 and 8, is performed therein a pelvis portion spreading or widening operation, on elasticized fabrics with mixed sizes.

In this pelvis portion spreading operation, by driving the cylinder 36, the templates or patterns 32 are moved away from one another to be properly put under tension.

As the trouser pelvis portion encounters the left template or pattern 32, with reference to the drawing, by distributing the force through the overall surface, a rotary movement about a fulcrum 37 is obtained, with a consequent interference between the amplifier 38 projecting from the pattern 32 and an electric limit switch 39, provided for locking the driving to the cylinder 36, by controlling an electric-pneumatic valve 40 for stopping the pelvis portion widening or spreading operation.

Thus, it is possible to automatically use the operating assembly on elasticized fabric cloth articles or trousers, which are accordingly brought to the desired size without the damaging the fabric material.

Figure 10:
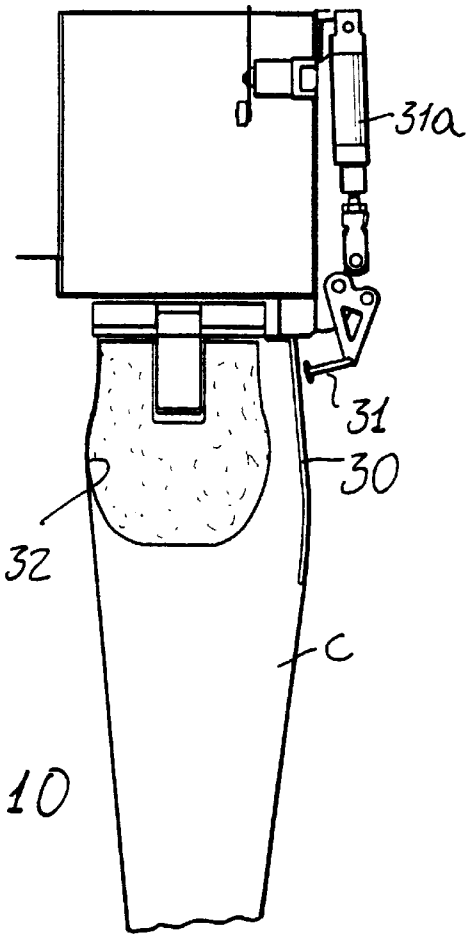
FIG. 10 schematically shows the assembly of FIG. 9, by a further side elevation view.
Figure 9:
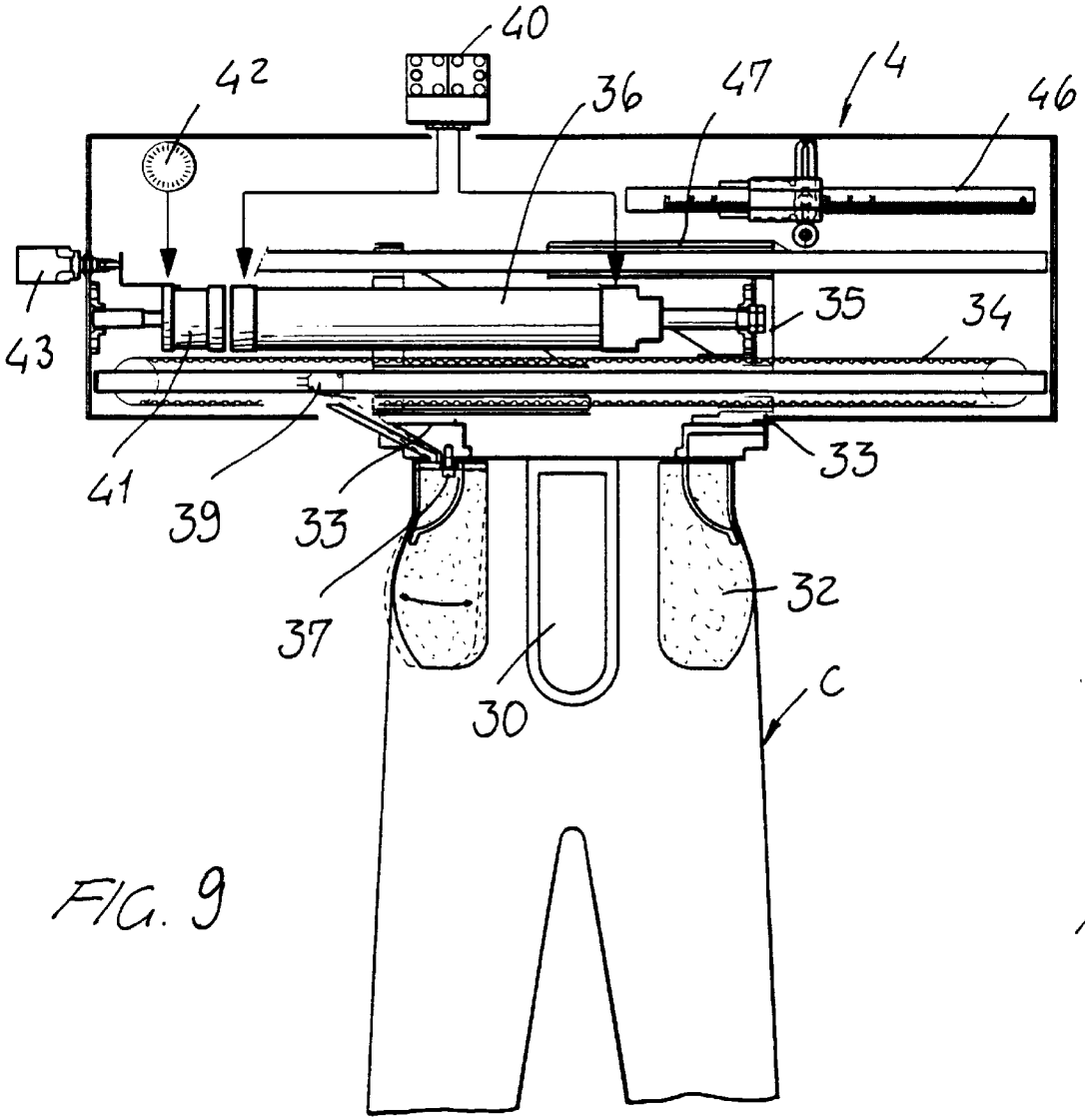
FIG. 9 is a front elevation view showing an operating assembly for processing or ironing jeans supplied with mixed sizes.

In a case in which the pelvis portion spreading operation is made on jeans cloth articles, supplied with mixed sizes, and as is shown in FIGS. 9 and 10, the pattern driving cylinder 36 is operatively driven to in turn drive the mentioned patterns which are advantageously made of molded and perforated stretched sheet metal elements; in this condition, as a pattern or mold encounters a cloth article, then the operating force will be transmitted to a pneumatic sensor 41 which will provide a pulling operation, depending on a pressure set through the pressure adjusting element 42.

Then, a second limit switch 43 is operated, for locking said cylinder 36, while holding such a locked position for the overall working cycle, up to the end of the ironing steps.

Figure 12:
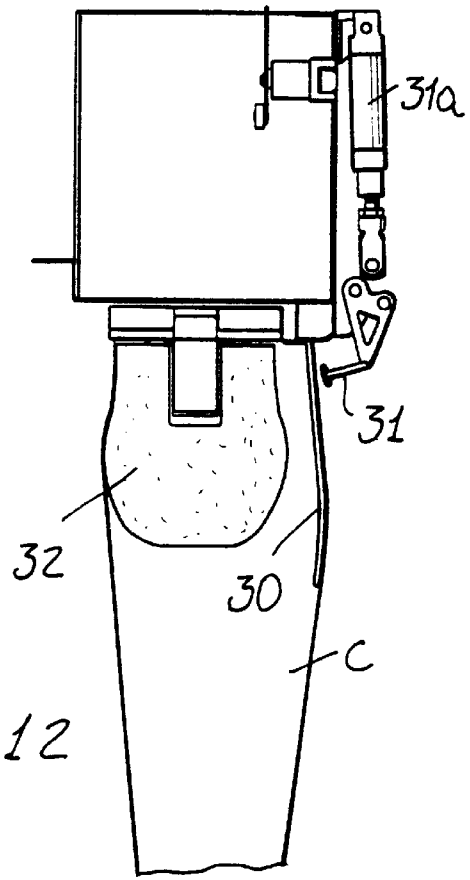
FIG. 12 is a side elevation view showing the assembly illustrated in FIG. 11.
Figure 11:
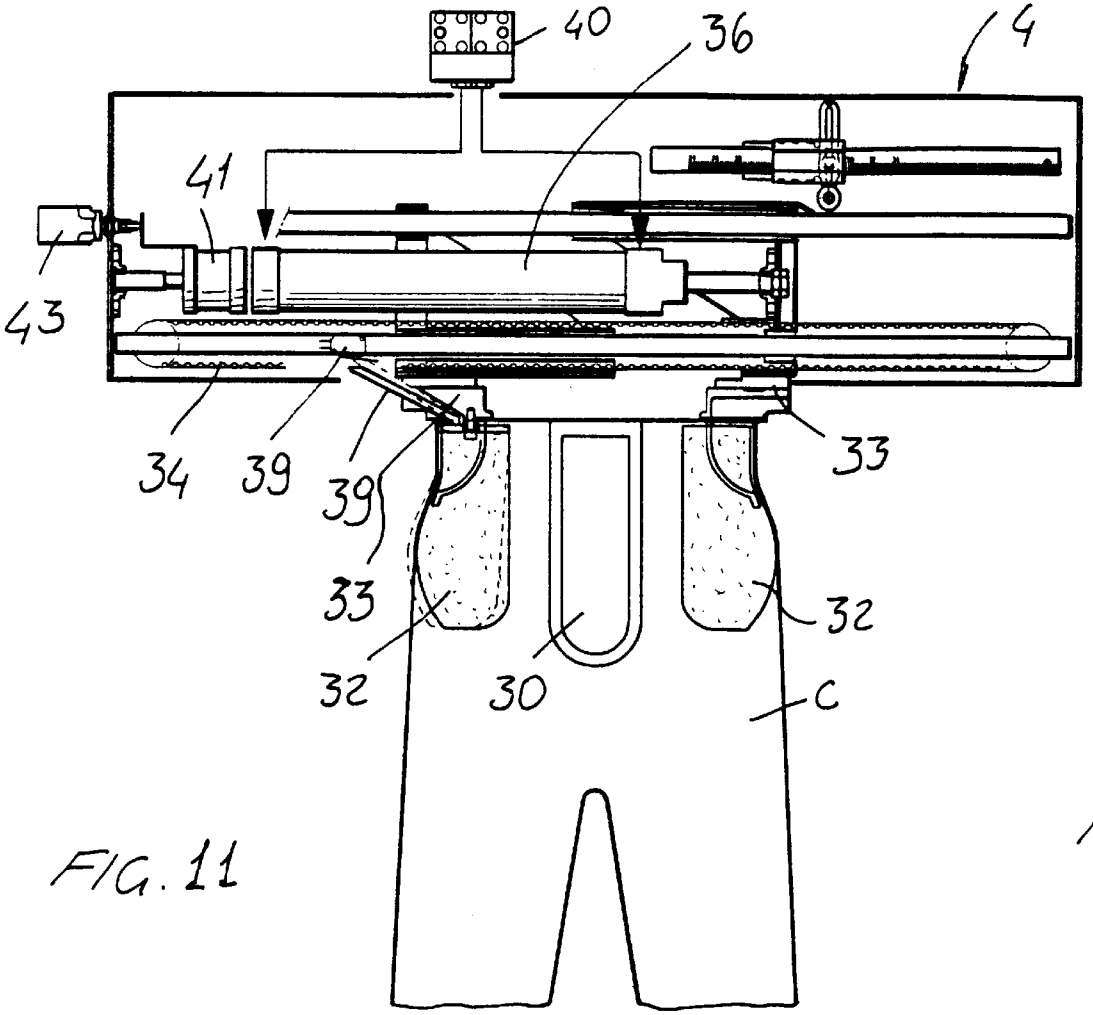
FIG. 11 shows an operating assembly during a sizing operation, being provided with an electric detent element, and operating on separated different size trousers.
Figure 14:
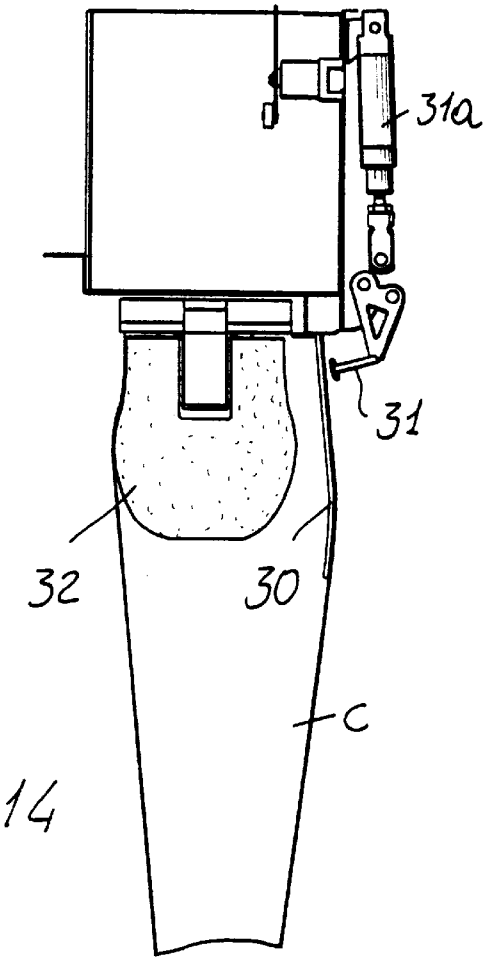
FIG. 14 is a side elevation view showing the operating assembly of FIG. 13.
Figure 13:
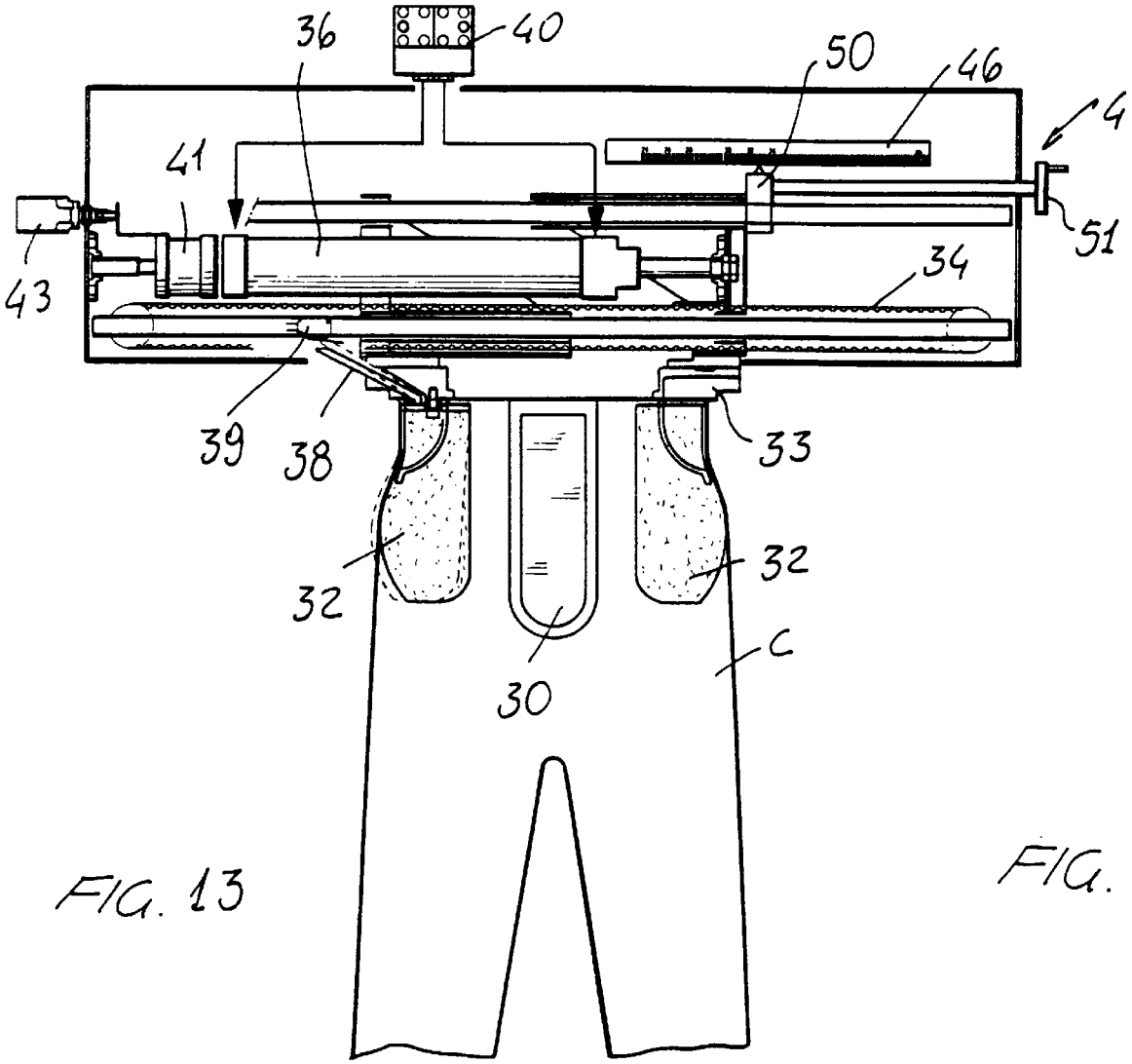
FIG. 13 is a further elevation view showing an operating assembly for performing the trouser sizing operation, and being provided with a mechanical detent element, operating on separated different size trousers.
Figure 15:
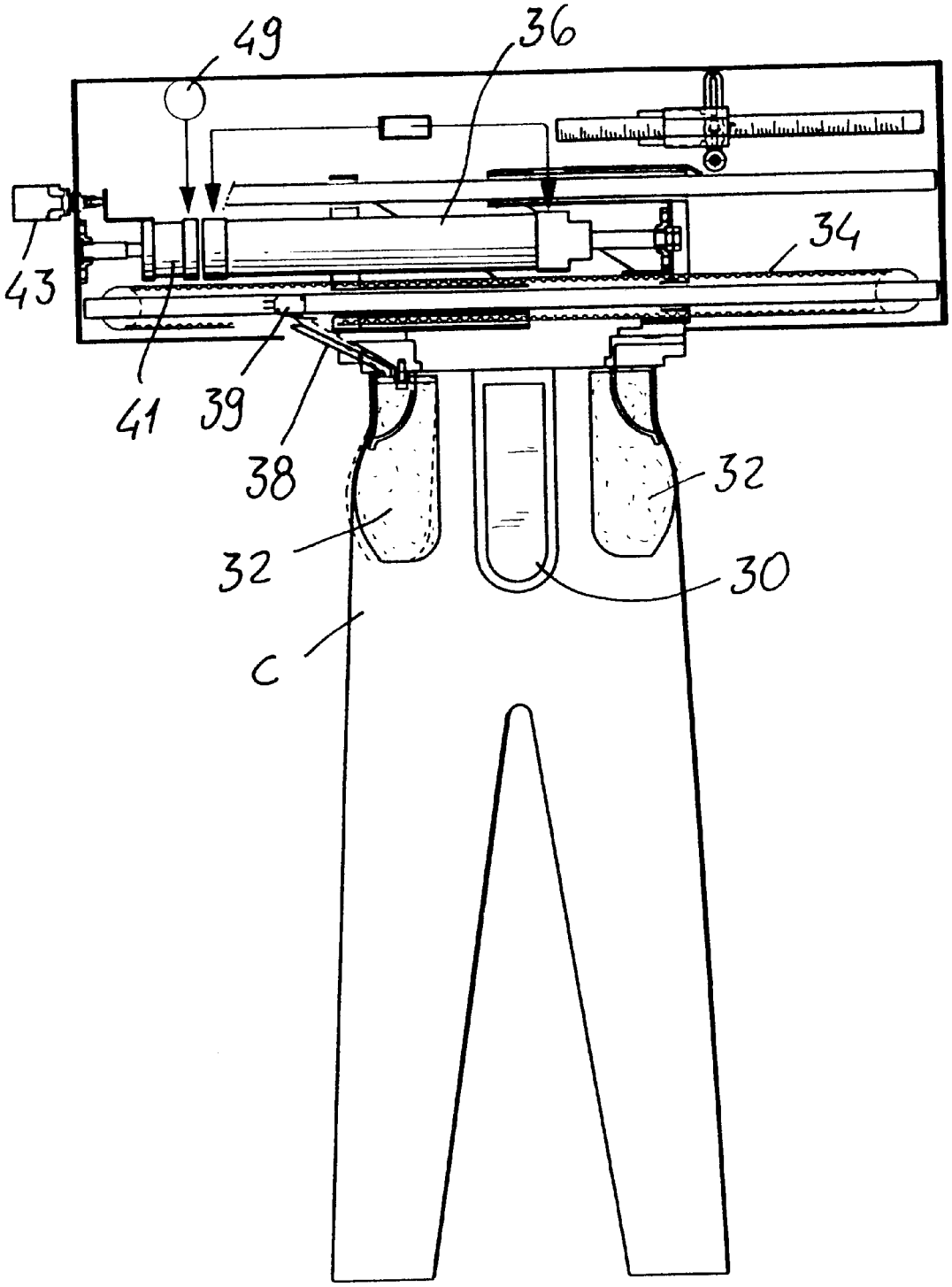
FIG. 15 shows the mentioned operating assembly during a trouser leg tensioning or pulling operation, and being provided with an electrical-pneumatic sensor.
Figure 16:
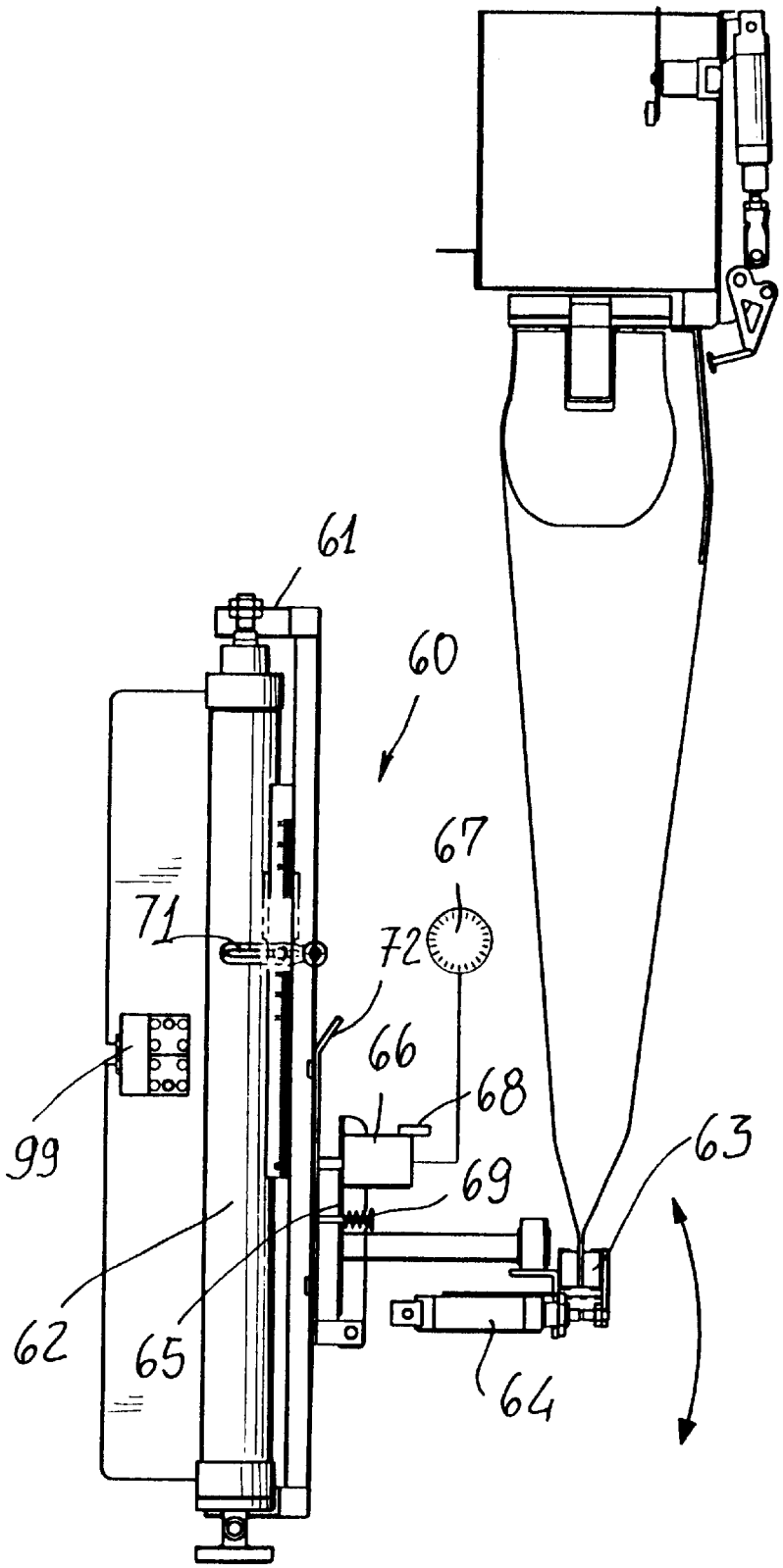
FIG. 16 is a further side elevation view showing the operating assembly of FIG. 15.

If the pelvis portion spreading operation is performed on cloth articles or trousers of different and separated sizes, as shown in FIGS. 11 and 12, then a further limit switch 45, arranged on a graduated rod 46 would be used, said graduated rod 46 being designed for interfering against a cam 47 which is operatively coupled to the spreading cylinder 36.

Under a pelvis portion spreading command, the cylinder will start the pelvis portion pulling or tensioning operation, as the cam 47 arrives at the pelvis portion spreading limit switch 45, as fitted on the graduated rod 46.

Then, the cylinder 36 is locked, through the valve 40, and the locked position will be held through the overall processing or working cycle.

Under such a condition, the counter-pressure cylinder 41 and related sensor are not operated.

On the other hand, the single piston 36 is used, which is driven by setting the pelvis portion spreading amount through the slider including the limit switch 45.

In a case in which the pelvis portion is spread with a simultaneous sizing operation, then, by operating on separated sizes, a detent pad 50 is provided, which can be properly located through the adjustment rod 46, and which constitutes a processing method alternative to the above disclosed method.

More specifically, the pad 50 can be properly located by operating a small wheel 51.

Under the pelvis portion spreading command, the spreading cylinder 36 is actuated for starting the pulling operation.

As the carriage arrives at the pad 50, properly located through the wheel 51 and graduated rod 46, then it will be blocked by holding the assembly in this set position through the overall processing or working cycle.

Each operating assembly comprises moreover a trouser leg pulling or tensioning assembly, generally indicated by the reference number 60 including an operating piston 61 for adjusting the displacement or stroke and locating of the pulling or tensioning assembly 60, which can be slidably driven by a vertical cylinder 62.

The operating assembly 60 further comprises a pair of grippers 63, which are driven by a gripper cylinder 64, engaging the end portions of the trousers.

The cylinders 64 are supported by a swinging rod 65 including a pneumatic sensor 66 constituted by a sensor piston, mounted on a swinging rod and being controlled by a pressure reducing unit for properly pulling the trouser legs 67.

Moreover, a leg pulling limit switch 68 and an adjusting spring 69 operating on the swinging rod are provided.

Upon a command related to the trouser leg elongation operation, the operating cylinder 62 will start the pulling or tensioning step.

As the trouser leg actuates the swinging carriage and rod 65, by a force controlled by the piston 66 and reducing unit 67, an elongation limit switch 68 is actuated for controlling a valve 99 of the vertical cylinder 64, and for locking said cylinder for the overall processing or working cycle.

Figure 17:
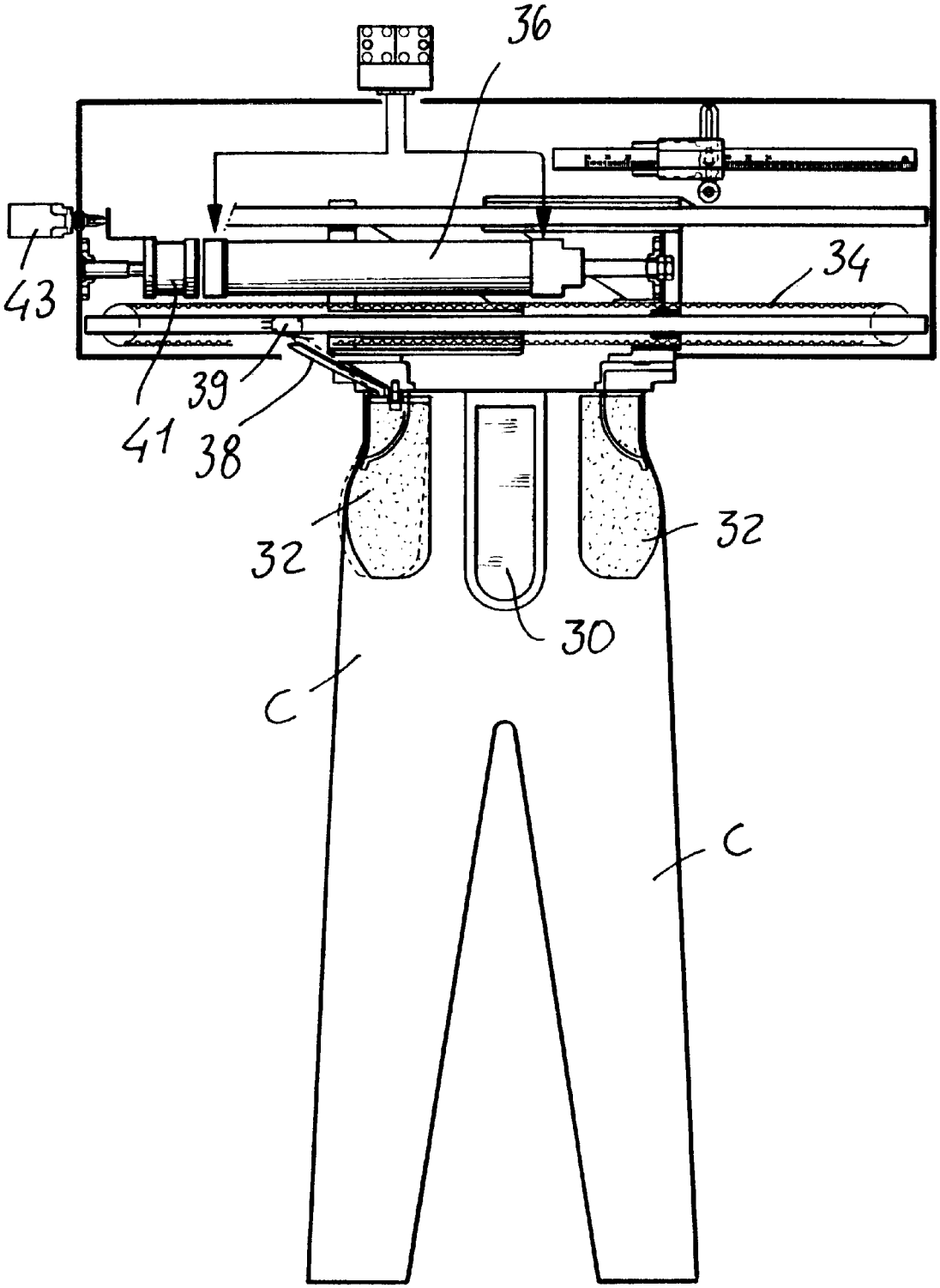
FIG. 17 is a further front elevation view showing the mentioned operating assembly, during the pulling of a trouser leg, for properly sizing the trousers and being provided with an electric-pneumatic detent element.
Figure 18:
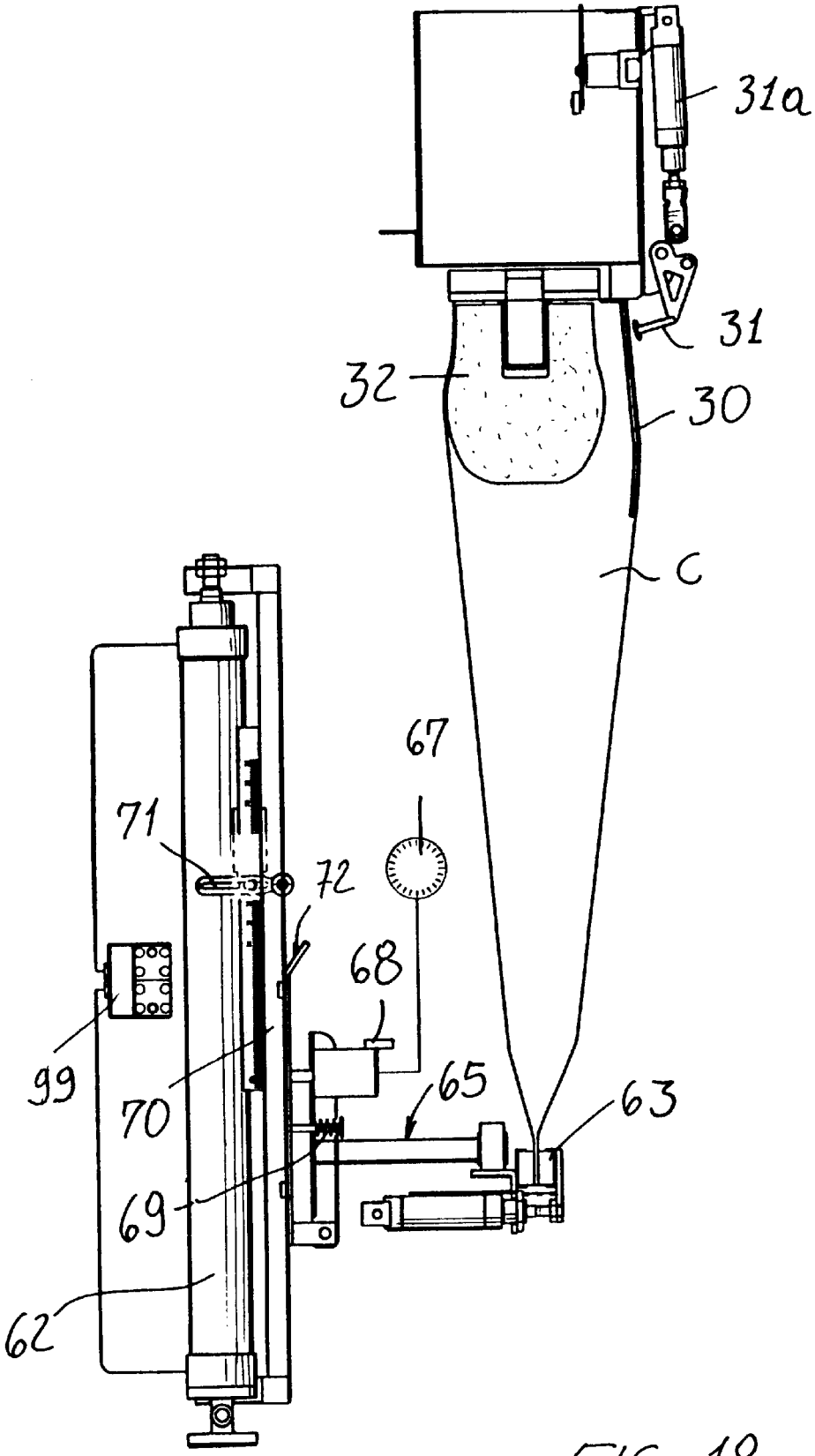
FIG. 18 is a further side elevation view showing the operating assembly of FIG. 17.

As shown in FIGS. 17 ands 18, the trouser leg can be properly pulled or tensioned by using an electric-pneumatic detent element.

To that end a vertical graduated rod 70 is provided on a vertical cylinder 62, and on said graduated rod 70 is provided an electric limit switch 71.

Moreover, for operating said detent element, a plurality of cams 72 are provided.

Under a trouser leg elongation command, the cylinder 62 starts the tensioning operation and, as the cams 72 engage with the limit switch 71, arranged on said graduated rod, then said cylinder will be locked through the valve 99, while holding this locked position for the overall working cycle.

The machine comprises moreover an assembly for taking the processed cloth articles or trousers, said taking assembly being generally indicated by the reference number 80.

More specifically, said taking or removing assembly comprises a pair of removing grippers 81 which are mounted on movable arms 82, which can be driven toward and away from the region wherein are arranged the mentioned operating assemblies 4, by a slanted pane guide 83, on which is driven a carriage 84 bearing a vertically movable supporting assembly 85 for supporting the arms 82.

Each gripper 81 comprises a supporting plate 90, thereon a gripper hook element 91 is articulated, said gripper hook element being turned by a gripper cylinder 92, for engaging in cutouts 32' defined by the pattern 32.

Moreover, a further pad 93 for allowing the grippers to hold the trousers at the belt height is provided.

Figure 19:
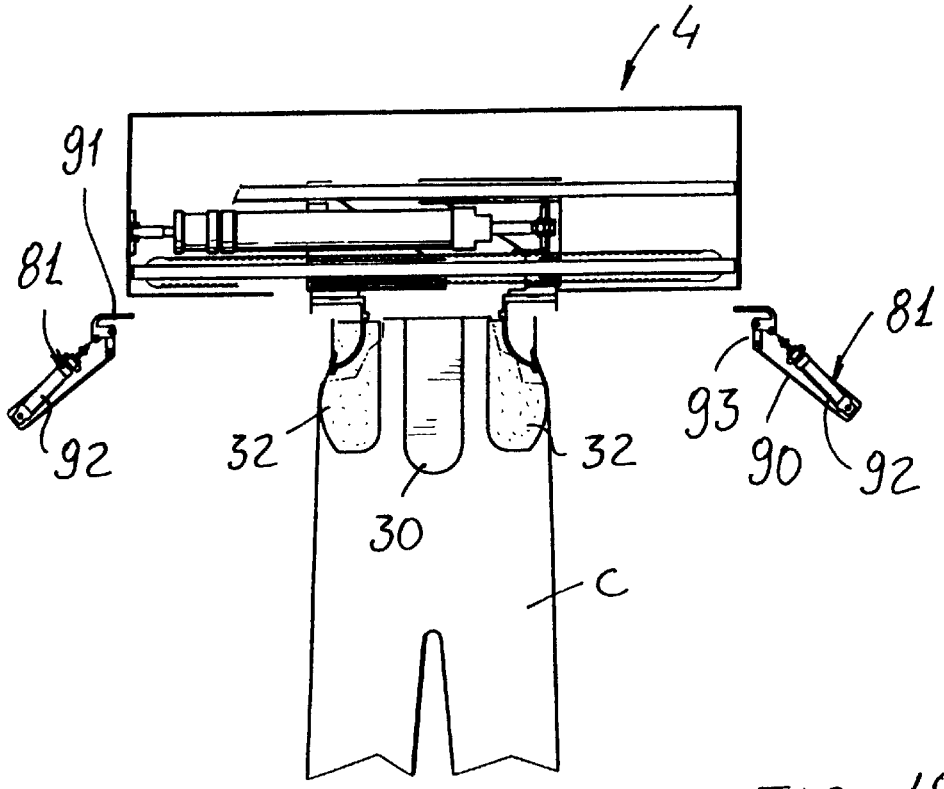
FIG. 19 is a schematic front view of the operating assembly, at the end of the trouser ironing or processing operation before the removal of the processed or ironed trousers.
Figure 20:
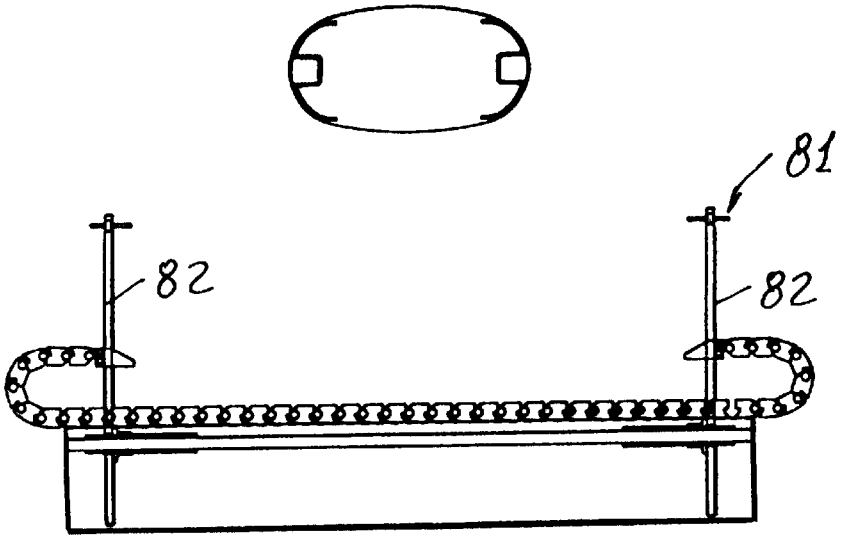
FIG. 20 is a top plan view showing the operating assembly in the operating position thereof shown in FIG. 19.
Figure 21:
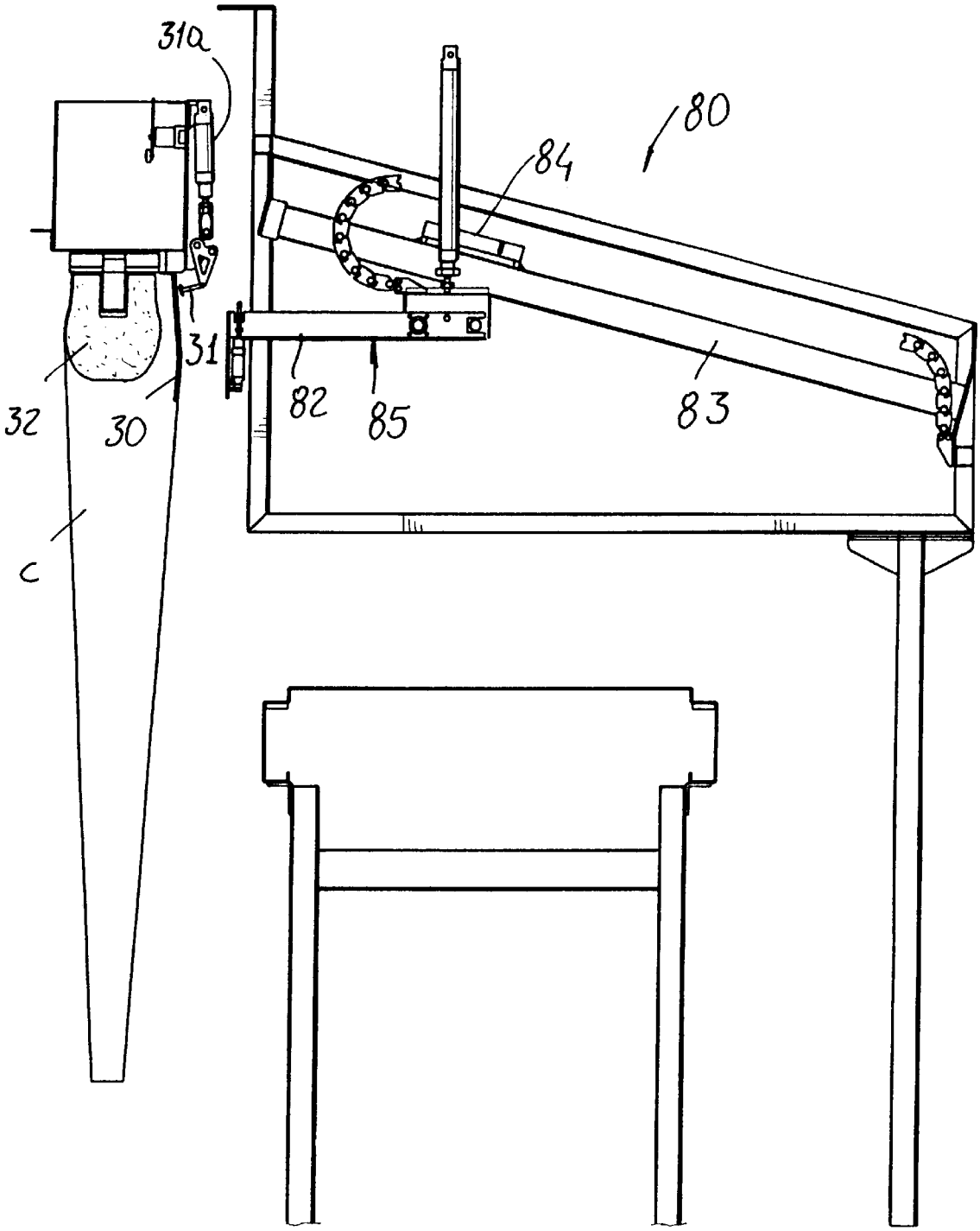
FIG. 21 is a further side elevation view illustrating the automatic ironing machine in the position of FIG. 19.
Figure 22:
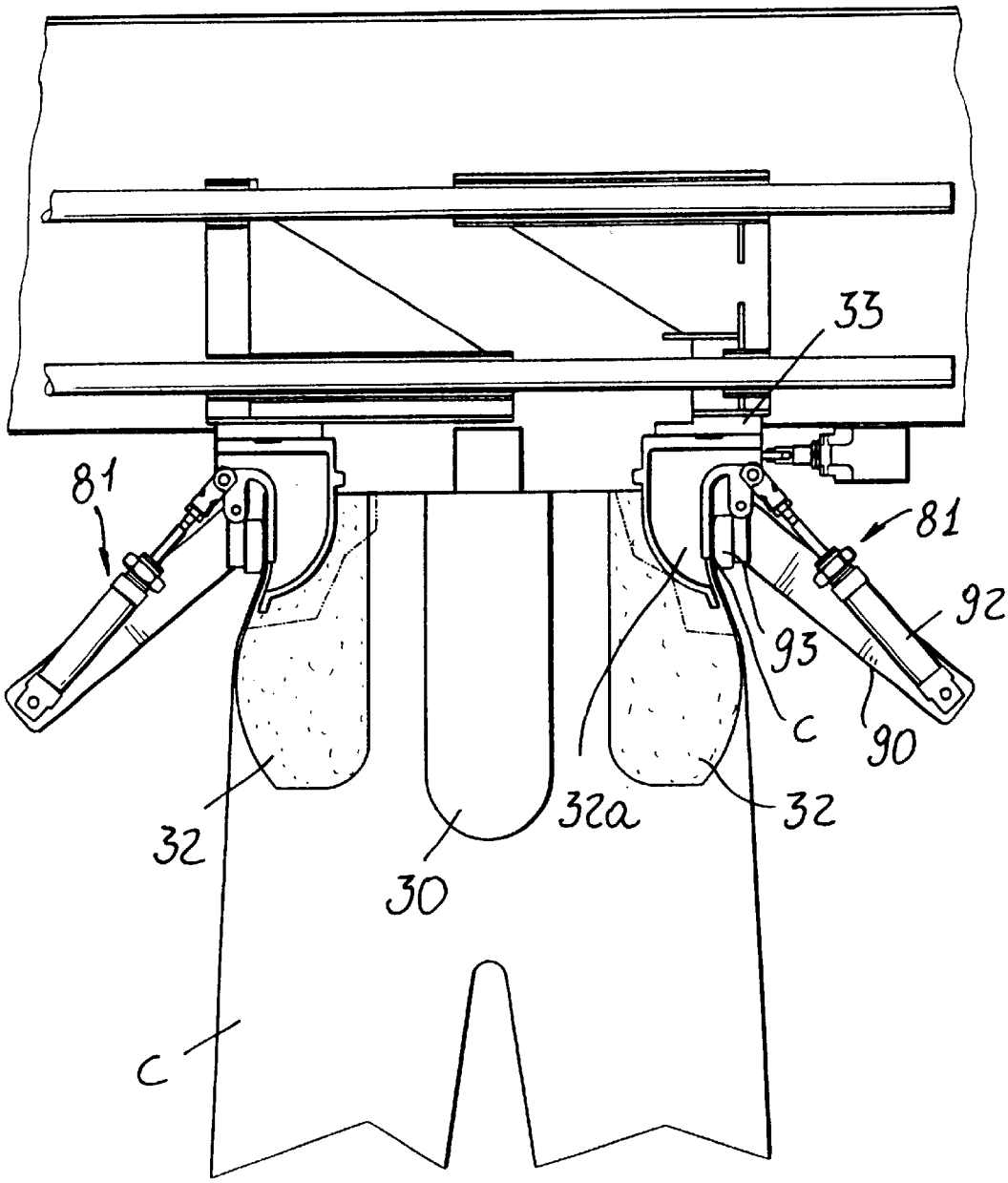
FIG. 22 is a front view showing an operating step in which the removal grippers are engaged with the cloth article or trousers, at the end of the ironing operation.

As shown in FIGS. 19 to 21, the grippers are herein represented in a spaced apart position and are so driven as to engage said patterns, as shown in FIG. 22.

Figure 25:
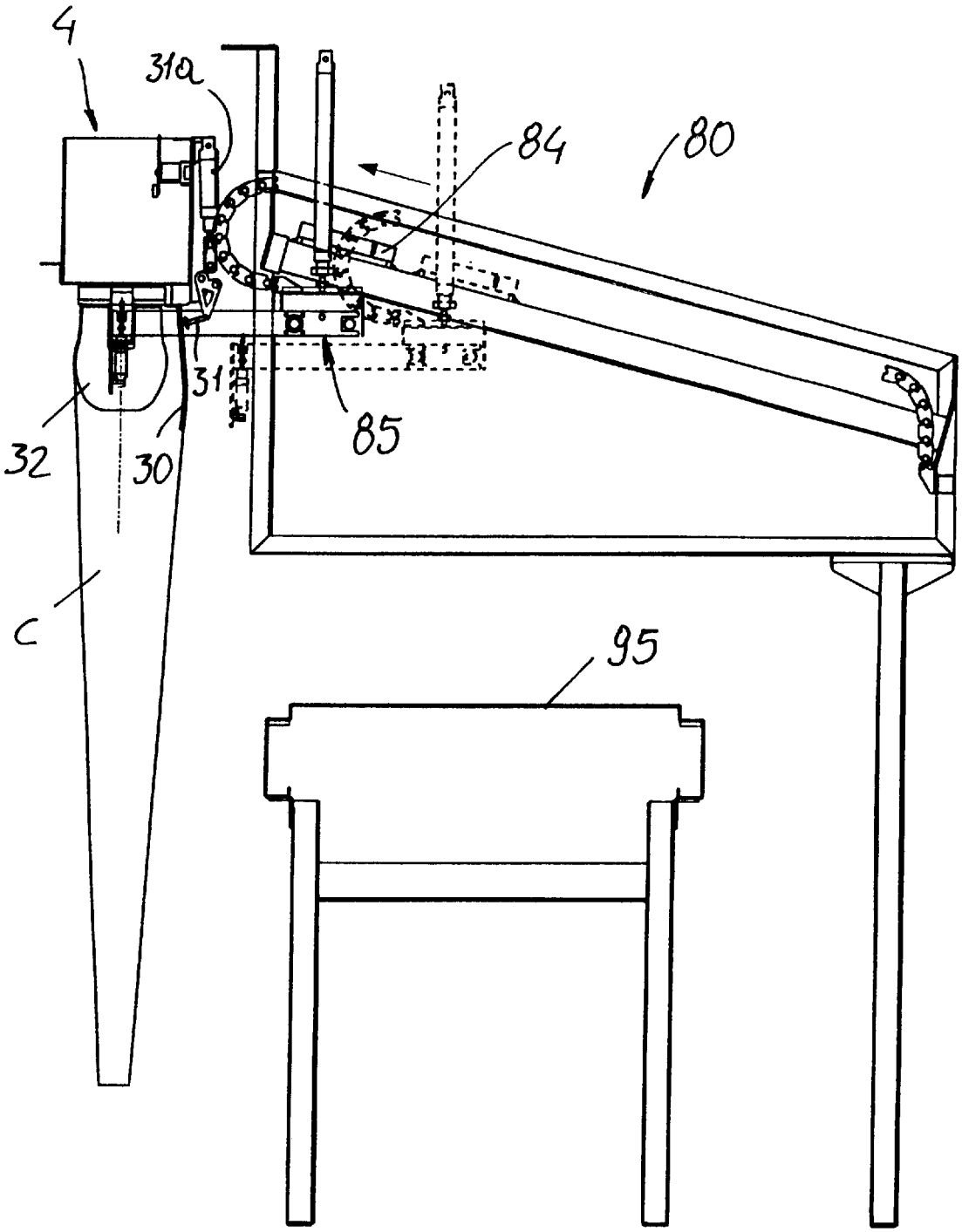
FIG. 25 is a further side elevation view showing the operating step of FIG. 23.
Figure 26:
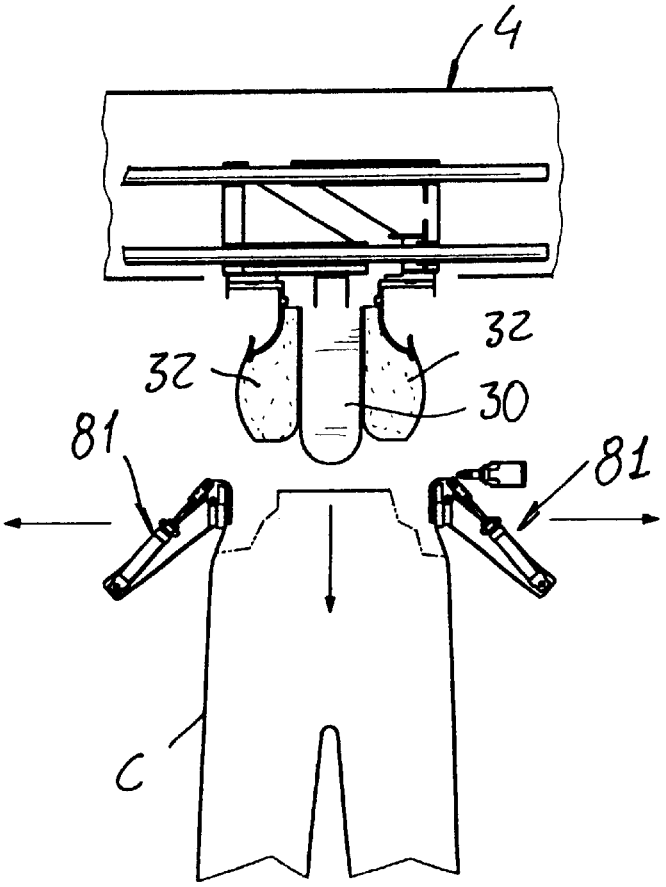
FIG. 26 is a further front view illustrating the removal operation or step in which the processed cloth article is removed from the related patterns.
Figure 27:
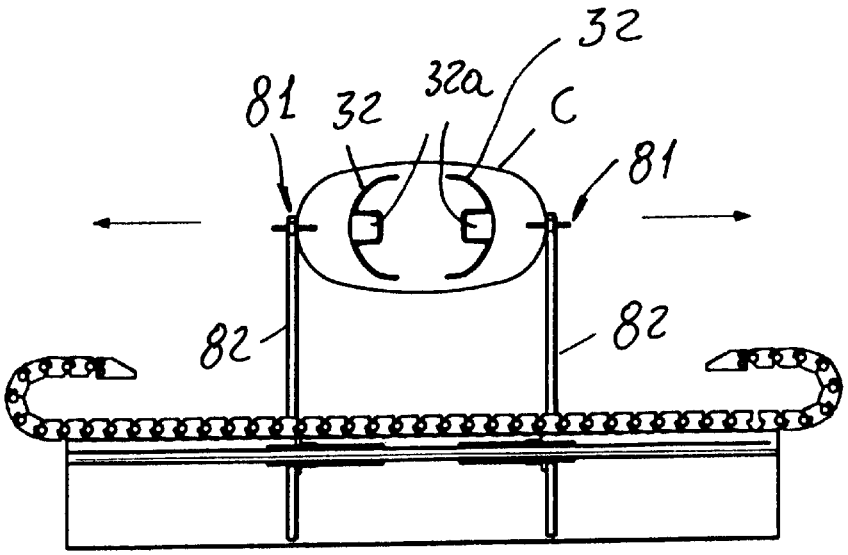
FIG. 27 is a top plan view showing the pattern unloading step or operation.
Figure 28:
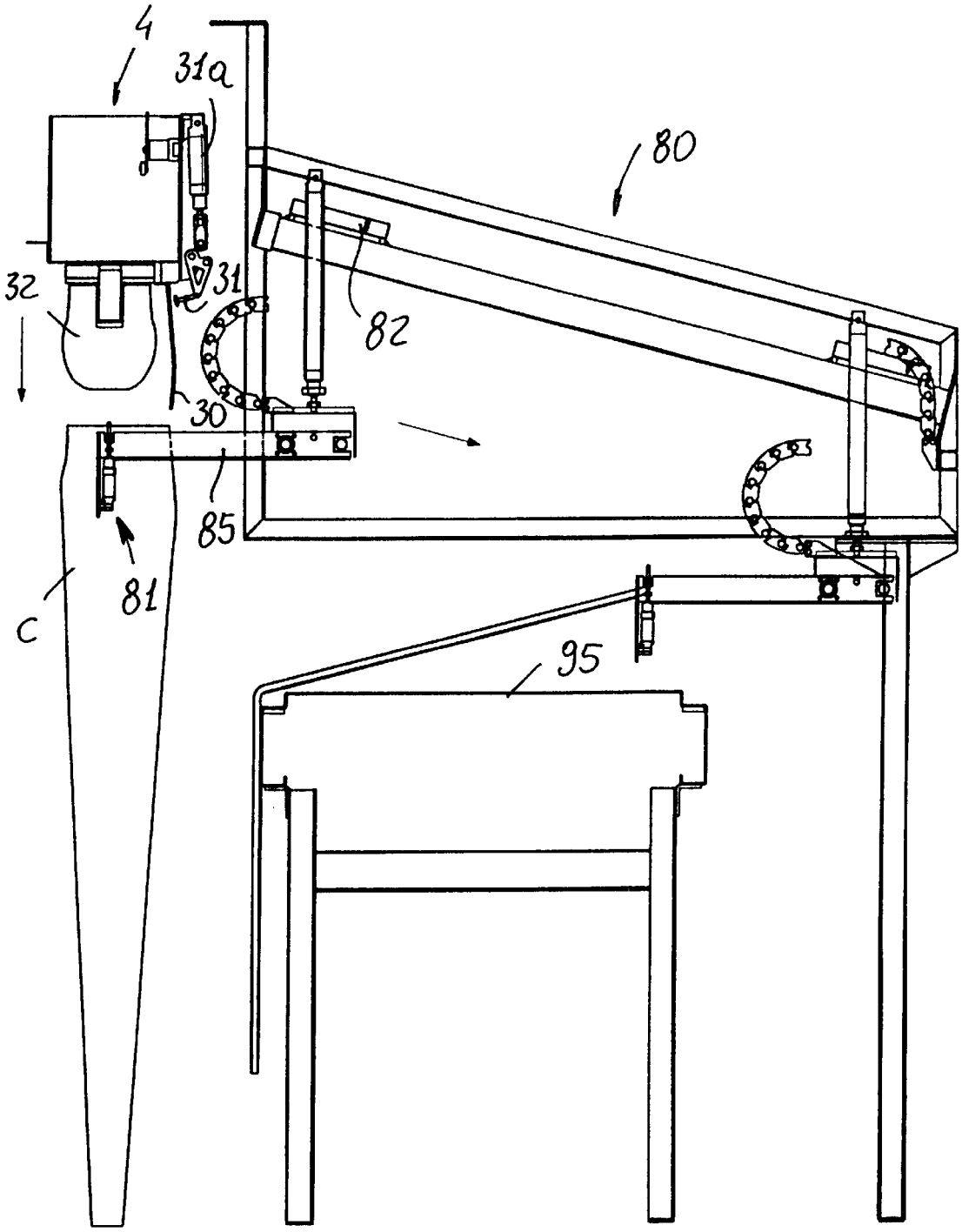
FIG. 28 is a side elevation view showing the unloading step in which the processed cloth article is unloaded from the patterns or molds.
Figure 29:
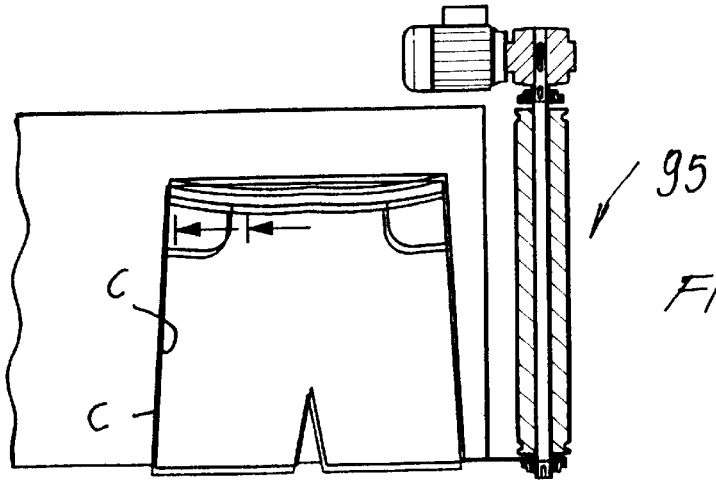
FIGS. 29, 30 and 31 shows three possible procedures for depositing the ironed or processed cloth article on an unloading or removing belt.
Figure 30:
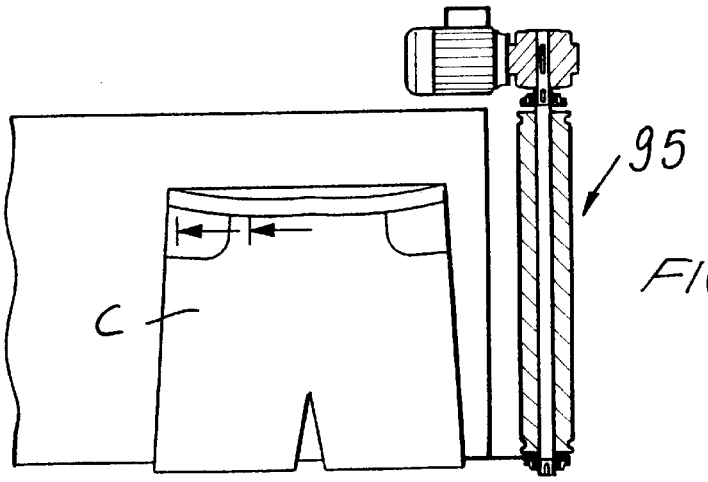
Figure 31:
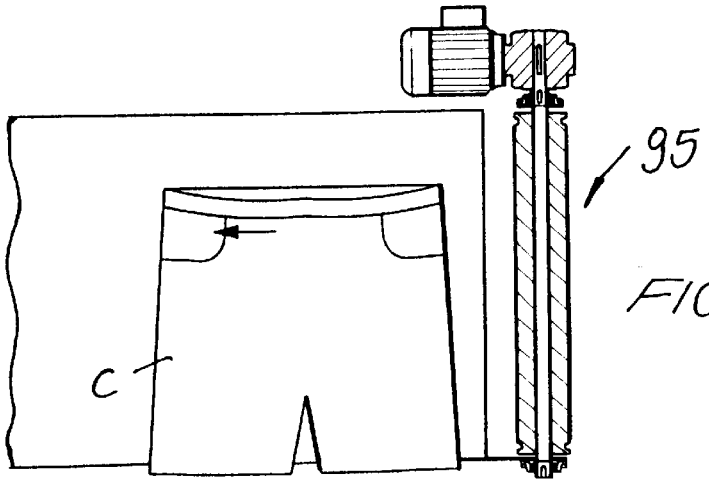
Figure 32:
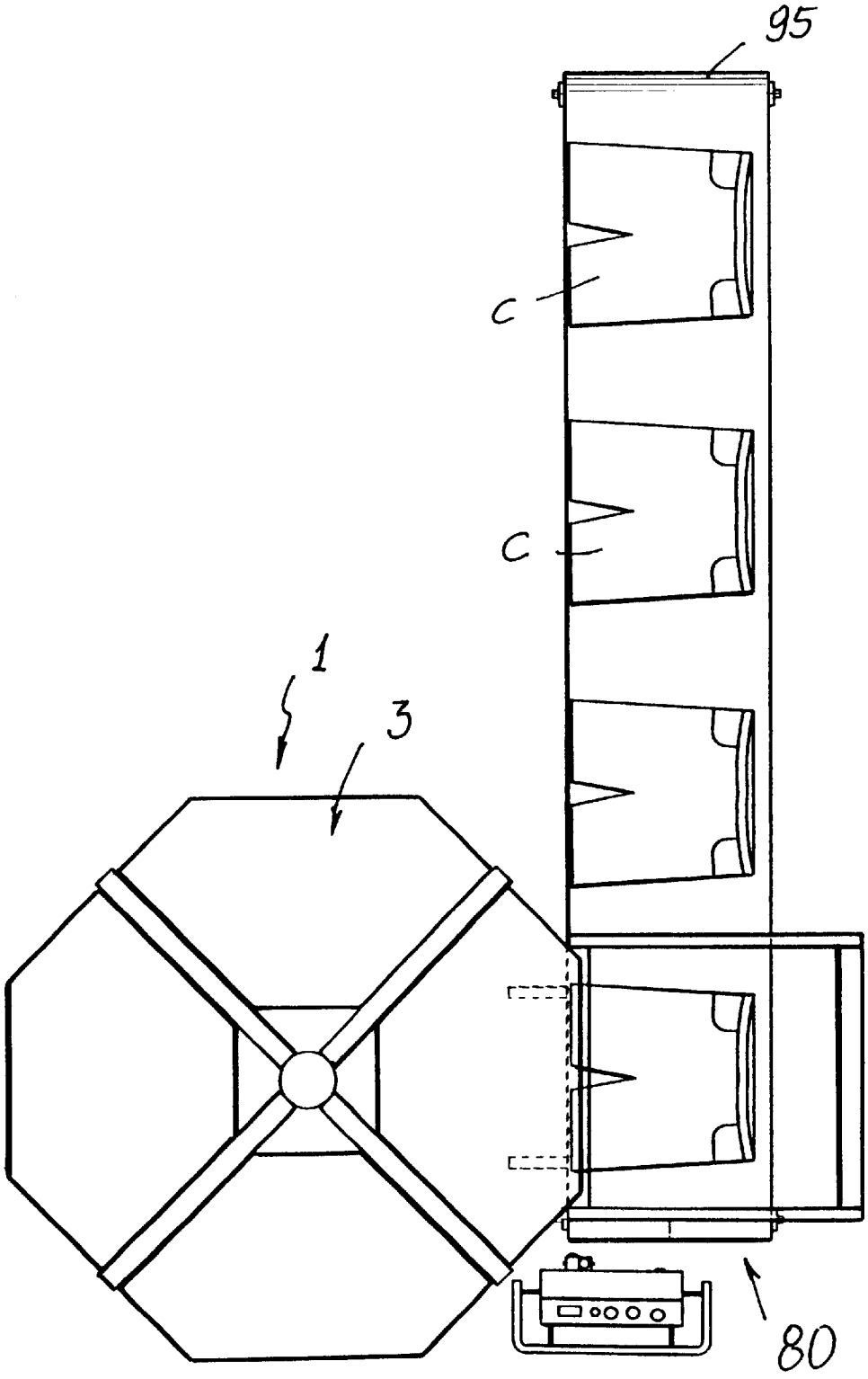
FIG. 32 is a schematic top plan view of the automatic ironing machine according to the present invention, in which the cloth articles are illustrated during an unloading operation thereof.

As the grippers 81 engage the cloth article or trousers at the belt level, then the patterns 32 will be caused to be withdrawn (FIGS. 23 to 25), the trousers being held supported by the grippers.

Said grippers, by operating a driving cylinder supporting the assembly 85, are downward driven to deposit the processed cloth article on a conveyor belt 95, which can be continuously driven or so driven as to provide a partial overlapping of the cloth articles or to provide an alternating overlapping thereof.

The cloth articles, as automatically processed, will be then removed from the machine through the conveyor belt 95 allowing to arrange said cloth articles as desired.

From the above disclosure it should be apparent that the invention fully achieves the intended aim and objects.

In particular, the fact is to be pointed out that an automatic ironing machine has been provided, which allows to process, by differently programmable mode of operation, a plurality of cloth articles or trousers.

Thus, it will be possible to precisely control the desired size of the trousers, both at the pelvis portion and at the leg portion thereof, while providing a quality size control of the trousers to be ironed.

In this connection it should be moreover pointed out that the ironing and setting operations can be performed in a fully automatic manner by the subject apparatus which, being of a transfer type, allows to simultaneously use a plurality of operating stations, in which it is possible to successively perform conventional ironing operations, by overheated steam and pressurized air jets.

The invention, as disclosed, is susceptible to several modifications and variations, all of which will come within the scope of the invention.

Moreover, all the constructional details can be replaced by other technically equivalent elements.

In practicing the invention, the used materials, as well as the contingent size and shapes, can be any, depending on requirements.

What is claimed is:

1. An automatic ironing machine, for ironing in a plurality of ironing steps, unfolded trousers made of an elasticized fabric, characterized in that said machine comprises a bearing framework rotatably supporting a carousel element supporting a plurality of operating assemblies for supporting the trousers being ironed, each said operating assembly being adapted to be programmed for automatically performing at least one of said ironing steps, depending on the type of said elasticized fabric and on a size of said trousers.

2. An automatic ironing machine, according to claim 1, characterized in that said carousel element supports four said operating assemblies.

3. An automatic ironing machine according to claim 1, characterized in that said machine comprises, inside said bearing framework, a blowing unit for blowing pressurized air in said operating assemblies, and that said blowing unit is coupled to a diffuser communicating with each of said operating assemblies through an adjustment gate.

4. An automatic ironing machine, according to claim 3, characterized in that said adjustment gate is driven by electric-pneumatic means.

5. An automatic ironing machine, according to claim 3, characterized in that said adjustment gate can be driven in any turning step of said carousel, either individually or in combination.

6. An automatic ironing machine, according to claim 1, characterized in that said machine comprises steaming assemblies, coupled to each said operating assembly, said steaming assemblies comprising a first and second steaming drums, each of which can be coupled to two different operating assemblies.

7. An automatic ironing machine, according to claim 6, characterized in that each of said steaming drums comprises a steam vessel, including a steam duct, on which operates a solenoid valve to control the communication with a steam coil, arranged inside an envelope, and that in said vessel is provided high pressure saturated steam and that, at an outlet of said coil is supplied atmospheric pressure overheated steam.

8. An automatic ironing machine, according to claim 7, characterized in that, for each said vessel, are provided first and second arms, respectively controlled by first and second solenoid valves, each said arm communicating with a coil arranged inside said vessel.

9. An automatic ironing machine, according to claim 1, characterized in that said machine comprises a rotary coupling for allowing said steam to enter and for discharging condensate material.

10. An automatic ironing machine, according to claim 1, characterized in that each said operating assembly comprises a fixed front plate which can be arranged inside a flap of the cloth article being processed and that, at said plate, is provided a pressing element driven by a cylinder for holding said trousers being processed.

11. An automatic ironing machine, according to claim 10, characterized in that a pair of patterns for the trouser pelvis portion are arranged near said front plate, said patterns being swingably mounted on horizontally moving sliders.

12. An automatic ironing machine, according to claim 11, characterized in that said front plate and pelvis portion patterns comprise a net element or a perforated metal sheet element.

13. An automatic ironing machine, according to claim 11, characterized in that said patterns are driven by driving means including a pelvis portion spreading cylinder coupled to a cogged belt coupling the sliders of the pelvis portion patterns which allows said sliders to be driven in opposite directions.

14. An automatic ironing machine, according to claim 1, characterized in that said operating assembly comprises an amplifier element for amplifying a swinging displacement of the pelvis portion pattern, said amplifying element being adapted to cooperate with an electric limit switch for locking said pelvis portion spreading cylinder during the use of the pelvis portion spreading operating assembly on elasticized fabrics with mixed sizes.

15. An automatic ironing machine, according to claim 1, characterized in that said operating assembly comprises a pneumatic sensor arranged in axial alignment with the pelvis portion spreading cylinder, said pneumatic sensor driving a second electric limit switch for driving said cylinder.

16. An automatic ironing machine, according to claim 15, characterized in that said machine comprises a graduated rod including a pelvis portion spreading limit switch adapted to interfere against a cam operatively coupled to said pelvis porion spreading cylinder, during a sizing operation on trousers of different sizes.

17. An automatic ironing machine, according to claim 1, characterized in that said operating assembly comprises a detent pad which can be located by a graduated rod, and that said pad is controlled by a pelvis portion spreading wheel, as the machine is operated on trousers of different sizes.

18. An automatic ironing machine, according to claim 1, characterized in that said operating assembly comprises a trouser legs pulling assembly including a piston which can be slidably driven through a vertical cylinder coupled to said bearing framework, said pulling assembly including a pair of grippers driven by a gripper cylinder.

19. An automatic ironing machine, according to claim 18, characterized in that said gripper cylinder is supported by a swinging rod including a pneumatic sensor constituted by a piston controlled by a pressure reducing unit.

20. An automatic ironing machine, according to claim 18, characterized in that said pneumatic sensor cooperates with a limit switch for tensioning the trouser legs.

21. An automatic ironing machine, according to claim 19, characterized in that said swinging rod is controlled by an adjusting spring.

22. An automatic ironing machine, according to claim 18, characterized in that said graduated rod is coupled to an electric limit switch, driving said vertical cylinder.

23. An automatic ironing machine, according to claim 1, characterized in that said machine further comprises a removal assembly for taking a processed trouser, said removal assembly including a pair of removing grippers mounted on gripper arms which can be driven towards and away from a region where said operating assemblies operate.

24. An automatic ironing machine, according to claim 23, characterized in that said arms are coupled by a vertically driving piston to a carriage coupled to a slanted plane.

25. An automatic ironing machine, according to claim 23, characterized in that each gripper comprises a supporting plate thereon a gripper hook element is pivoted, said gripper hook element being rotatively driven by a gripper cylinder for engaging said gripper hook element in cutouts defined by the pelvis portion patterns, and including an abutment pad for said grippers for holding said trousers at the belt level.

26. An automatic ironing machine, according to claim 1, characterized in that said machine comprises a conveyor belt for conveying ironed trousers, said conveyor belt being either continuously or intermittently movable, and being arranged under a trouser releasing region said conveyor belt being designed for overlapping the processed trousers or for arranging said processed trousers with a spaced and offset relationship.

* * * * *